US012297024B2

(12) United States Patent
Haas

(10) Patent No.: US 12,297,024 B2
(45) Date of Patent: May 13, 2025

(54) CONTAINER WITH AN INNER BODY, AN OUTER BODY, AND A DETACHABLE COVER

(71) Applicant: Vinglace LLC, Houston, TX (US)

(72) Inventor: Colton Bryan Haas, Houston, TX (US)

(73) Assignee: Vinglace LLC, Houston, TX (US)

( * ) Notice: Subject to any disclaimer, the term of this patent is extended or adjusted under 35 U.S.C. 154(b) by 60 days.

(21) Appl. No.: 18/245,813

(22) PCT Filed: Oct. 1, 2021

(86) PCT No.: PCT/US2021/053070
§ 371 (c)(1),
(2) Date: Mar. 17, 2023

(87) PCT Pub. No.: WO2022/072767
PCT Pub. Date: Apr. 7, 2022

(65) Prior Publication Data

US 2024/0025614 A1 Jan. 25, 2024

Related U.S. Application Data

(60) Provisional application No. 63/086,249, filed on Oct. 1, 2020.

(51) Int. Cl.
*B65D 77/04* (2006.01)
*B65D 25/20* (2006.01)
(Continued)

(52) U.S. Cl.
CPC ..... *B65D 77/0493* (2013.01); *B65D 25/20* (2013.01); *B65D 43/0229* (2013.01);
(Continued)

(58) Field of Classification Search
CPC ..... B65D 81/3869; B65D 77/0493; B65D 77/0486; B65D 77/048; B65D 25/20;
(Continued)

(56) References Cited

U.S. PATENT DOCUMENTS 2,103,679 A * 12/1937 Kline ..... B65D 85/302 206/521
3,356,243 A * 12/1967 Piker ..... A47J 41/0077 D7/608
(Continued)

FOREIGN PATENT DOCUMENTS

CN 209360292 U 9/2019
CN 305457168 11/2019
(Continued)

OTHER PUBLICATIONS

Hyperchiller, Introducing the New and Improved Hyperchiller V2, Jan. 4, 2019, 4 pgs. https://hyperchiller.us/pages/new-improved-hyperchiller%C2%AE-v2-iced-coffee-maker.
(Continued)

*Primary Examiner* — Robert J Hicks
(74) *Attorney, Agent, or Firm* — Womble Bond Dickinson (US) LLP

(57) ABSTRACT

Embodiments relate to containers capable of holding food and/or beverages. In some embodiments, the container may have an outer body and an inner body. The outer body may define an interior space and have an opening leading from the exterior into the interior space. In some embodiments, the inner body may be configured to be provided concentrically within the interior space, and may include a cavity configured to retain food or beverage. In some embodiments, the inner body may be removably retained within the interior space of the outer body. Some embodiments may also include a cover configured to be detachably coupled to the inner body and the outer body, for example to close the opening of the container.

20 Claims, 34 Drawing Sheets

(51) Int. Cl.

| | |
|---|---|
| ***B65D 43/02*** | (2006.01) |
| ***B65D 47/12*** | (2006.01) |
| ***B65D 51/18*** | (2006.01) |
| ***B65D 53/02*** | (2006.01) |
| ***B65D 81/38*** | (2006.01) |

(52) U.S. Cl.

CPC ..... *B65D 47/12* (2013.01); *B65D 51/18* (2013.01); *B65D 53/02* (2013.01); *B65D 81/3869* (2013.01); *B65D 2251/205* (2013.01); *B65D 2543/00092* (2013.01); *B65D 2543/0049* (2013.01); *B65D 2543/00972* (2013.01)

(58) Field of Classification Search

CPC ..... B65D 43/0229; B65D 43/0225; B65D 47/122; B65D 47/12; B65D 51/18; B65D 53/02; B65D 2251/205; B65D 2543/00092; B65D 2543/0049; B65D 2543/00972

USPC ..... 215/13.1, 44, 45, 364, 356, 355; 220/62.18, 62.15, 62.12, 506, 293, 288, 220/560.1, 560.12, 592.27, 592.26, 592.2

See application file for complete search history.

(56) References Cited

U.S. PATENT DOCUMENTS

| | | | | |
|---|---|---|---|---|
| 4,184,601 | A * | 1/1980 | Stewart | A47J 41/02 220/592.27 |
| 5,901,882 | A | 5/1999 | Siegel | |
| D614,440 | S | 4/2010 | Cresswell et al. | |
| D675,066 | S | 1/2013 | Conlin et al. | |
| 8,561,825 | B1 * | 10/2013 | Kino | B65D 81/3869 220/592.16 |
| D722,829 | S | 2/2015 | Valderrama et al. | |
| 9,360,248 | B1 | 6/2016 | Efferding | |
| D784,084 | S | 4/2017 | Bartlett et al. | |
| 9,681,771 | B2 | 6/2017 | Herling et al. | |
| 9,930,980 | B2 | 4/2018 | Pau | |
| D817,683 | S | 5/2018 | Melanson et al. | |
| D839,058 | S | 1/2019 | Irish | |
| 10,196,254 | B2 | 2/2019 | Kincaid et al. | |
| 10,427,858 | B2 | 10/2019 | Mackintosh et al. | |
| 10,457,471 | B2 | 10/2019 | Jacob | |
| 2009/0212059 | A1 | 8/2009 | Chen | |
| 2012/0125931 | A1 * | 5/2012 | Roth | B65D 43/0231 220/254.3 |
| 2014/0091097 | A1 | 4/2014 | Lane | |
| 2016/0088960 | A1 * | 3/2016 | Liang | B65D 81/3869 220/560.01 |
| 2019/0233198 | A1 | 8/2019 | Haas | |
| 2019/0389645 | A1 | 12/2019 | Haas | |
| 2020/0253401 | A1 | 8/2020 | Haas | |
| 2020/0361680 | A1 * | 11/2020 | Levy | B65D 47/122 |
| 2020/0391913 | A1 * | 12/2020 | Ames | A45F 3/18 |
| 2021/0039846 | A1 * | 2/2021 | Jinkins | B65D 51/18 |

FOREIGN PATENT DOCUMENTS

| | | | | |
|---|---|---|---|---|
| DE | 10035708 | A1 | 1/2002 | |
| DE | 202015008242 | U1 | 3/2016 | |
| EP | 869080 | A1 * | 10/1998 | B65D 83/0027 |
| WO | 2005095226 | A1 | 10/2005 | |
| WO | 2022072767 | A2 | 4/2022 | |

OTHER PUBLICATIONS

International Searching Authority; International Search Report and Written Opinion of the International Searching Authority for PCT/US21/53070; mailed on Apr. 22, 2022; 11 pages.

* cited by examiner

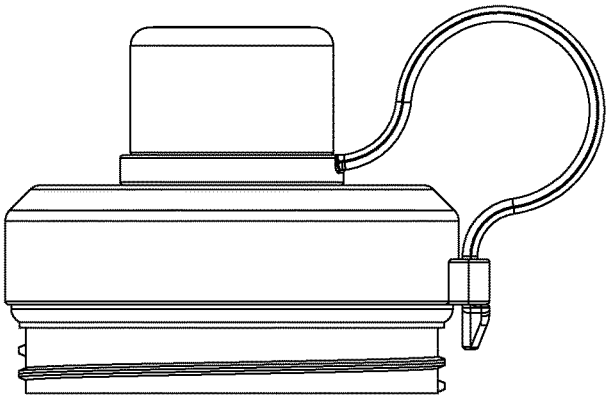
FIG. 41
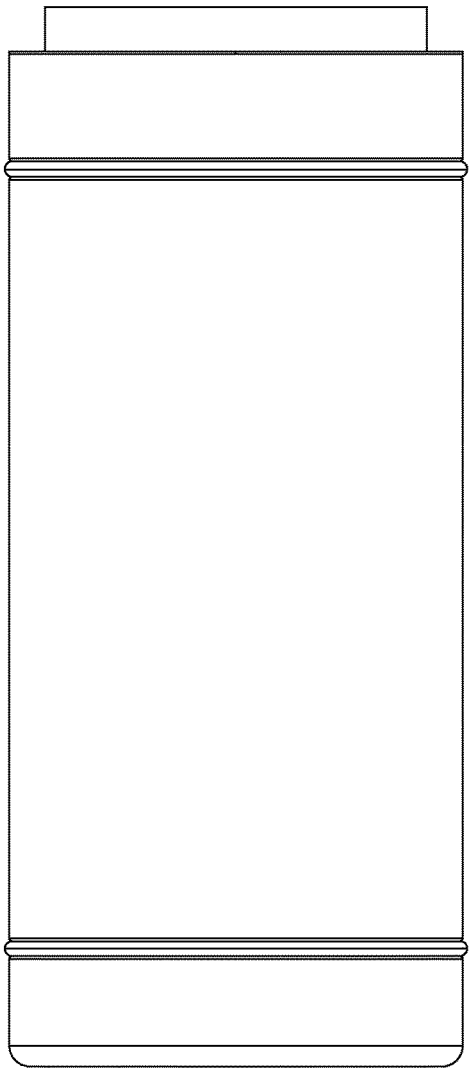

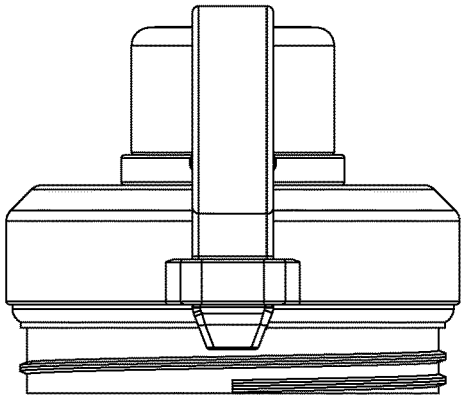
FIG. 42
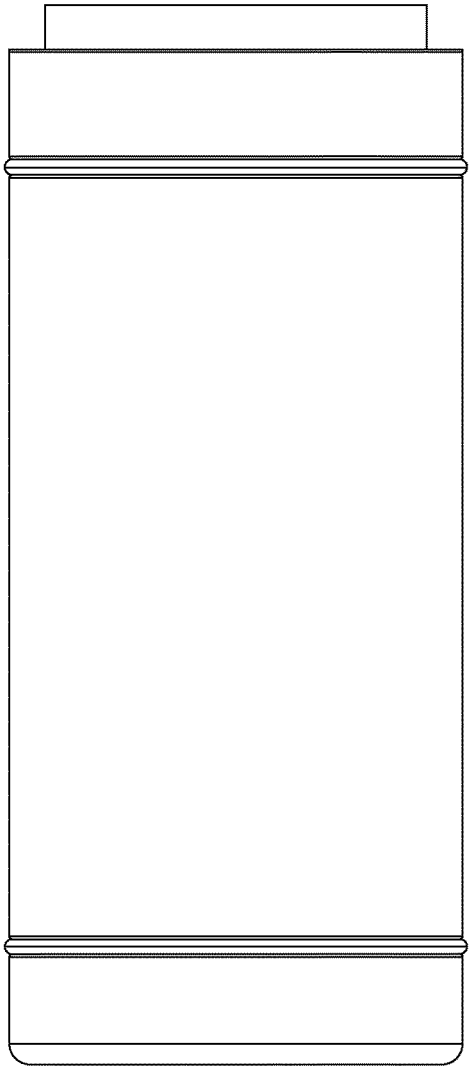

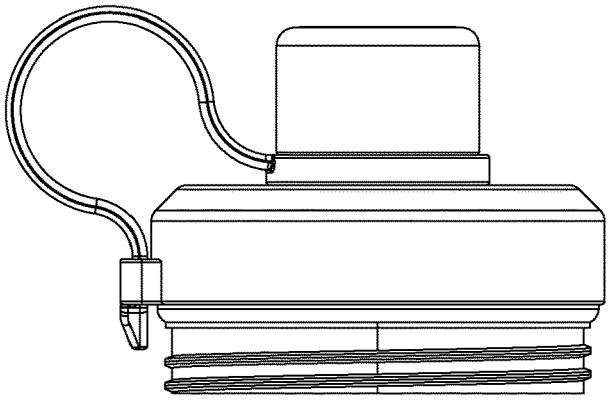
FIG. 43
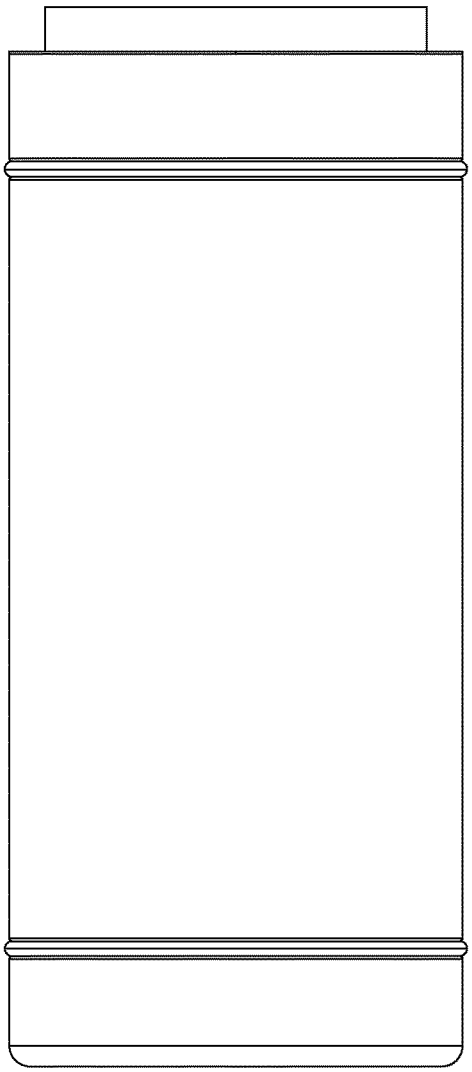

CONTAINER WITH AN INNER BODY, AN OUTER BODY, AND A DETACHABLE COVER

CROSS-REFERENCE TO RELATED APPLICATIONS

This application is a national stage application of and claims priority to Patent Cooperation Treaty (PCT) Application No. PCT/US2021/053070 filed Oct. 1, 2021, which claims the benefit of U.S. Provisional Patent Application No. 63/086,249 filed Oct. 1, 2020. The entire contents of each of the applications listed above are incorporated herein by reference.

BACKGROUND OF THE DISCLOSURE

While any number of containers for housing and retaining food items and beverages exist, the need for improvements, particularly with respect to certain specific uses, continues to evolve. Typically, such containers must be food-safe, for example formed of materials with no significant risk of contamination of the food or beverage from the material. Unfortunately, some such materials, while safe and effective in many respects, may impart undesirable traits to the food or beverage being stored within the container. For example, the container may impart an unpleasant taste. In other embodiments, the container may retain a flavor from previous food or beverage, which may negatively impact future food or beverage storage. It is possible that container materials could, over time and/or under certain circumstances, leach materials into food or beverages stored therein, which could pose a health risk. And in some embodiments, container materials may be prone to breakage and/or reduced durability.

Additionally, container designs may make cleaning, especially dishwasher-safe cleaning, difficult, thus negatively impacting functionality and/or convenience for end-users. Also, for consumer products, design and aesthetic features can be important, both for improved utilitarian functionality and for improved consumer experience. For example, some conventional containers may have an unpleasant mouthfeel that can negatively impact consumer usage. Because of these and other issues with conventional containers for food and/or beverages, there exists a need for improved containers, which may address one or more of these needs.

BRIEF DESCRIPTION OF THE EXEMPLARY EMBODIMENTS

According to an aspect, the exemplary embodiments include a container (for example, for food and/or beverage) having an outer body and an inner body. In some embodiments, the outer body may include an outer body cylindrical wall extending in an axial direction, and an outer body end wall provided at a first end of the outer body cylindrical wall in the axial direction. According to an aspect, the outer body cylindrical wall and the outer body end wall together define an interior space (having an opening). In some embodiments, the inner body may be provided, for example removably, concentrically within the interior space (or configured to be so), and may include an inner body cylindrical wall extending in the axial direction, and an inner body end wall provided at a first end of the inner body cylindrical wall in the axial direction. Some embodiments may also include a cover configured to be detachably coupled to the inner body and the outer body (e.g. to close the opening of the container). For example, the cover may have a cover plate with an inner cover cylinder and an outer cover cylinder extending from a first side of the cover plate.

In another aspect, the exemplary embodiments include a cover for use with a container. The cover may include a cover plate, an inner cover cylinder extending from the cover plate to a first side in the axial direction, and an outer cover cylinder concentric with the inner cover cylinder and extending from the cover plate to the first side in the axial direction. For example, the cover may be configured to close the open end of a container, which may have an inner body disposed within an outer body. A gap may be formed radially between the inner cover cylinder and the outer cover cylinder, and the gap may be configured to contain a top end of the inner body of the container between the inner cover cylinder and the outer cover cylinder. In some embodiments, the outer cover cylinder may be configured for attachment to a top end of the outer body of the container.

In a further aspect, the exemplary embodiments include a container body having a cylindrical wall extending in an axial direction, and an end wall provided at a first end of the cylindrical wall in the axial direction. In some embodiments, the container body may include an outer body and an inner body. In some embodiments, the inner body may be configured to be provided concentrically within an interior space of the outer body. In some embodiments, the inner body may be configured to be removably received within the outer body. Some embodiments may further include a cover, which may be configured for detachable coupling to the inner body and the outer body. In some embodiments, the cover may include a cover plate, an inner cover cylinder, and an outer cover cylinder, with both the inner and outer cover cylinders extending from a first side of the cover plate. In some embodiments, the outer body of the container may have an outer body thread on an inner surface of the outer body, and the outer cover cylinder may have a cover thread on its outer surface which is configured to removably engage with the outer body thread.

BRIEF DESCRIPTION OF THE DRAWINGS

A more particular description will be rendered by reference to exemplary embodiments that are illustrated in the accompanying figures. Understanding that these drawings depict exemplary embodiments and do not limit the scope of this disclosure, the exemplary embodiments will be described and explained with additional specificity and detail through the use of the accompanying drawings in which:

FIG. 41 illustrates a first side view (of the container of FIG. 39;

FIG. 42 illustrates a second side view of the container of FIG. 39;

FIG. 43 illustrates a third side view of the container of FIG. 39;

Figure 1:
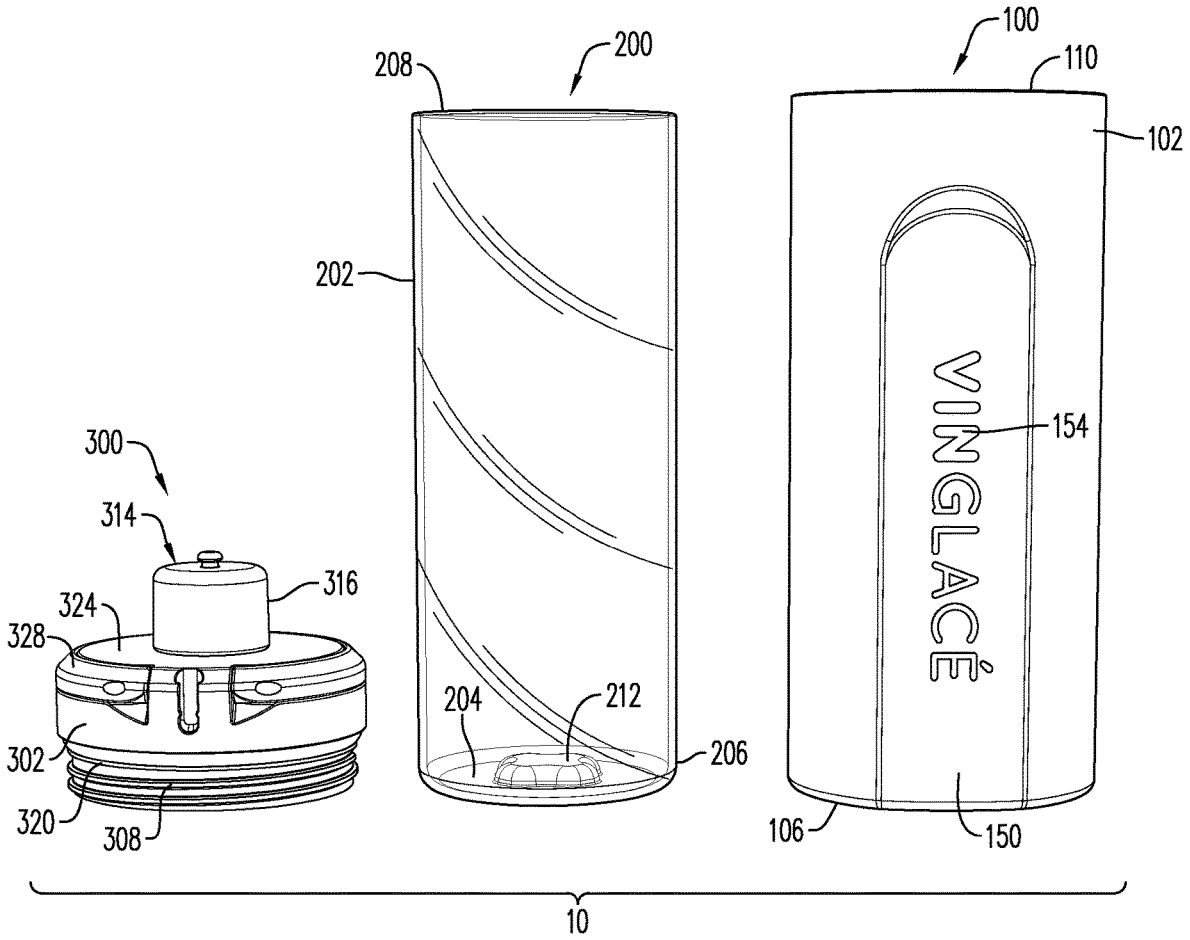
FIG. 1 is perspective view of a container, illustrating the container in a partially disassembled configuration, according to an embodiment.
Figure 2:
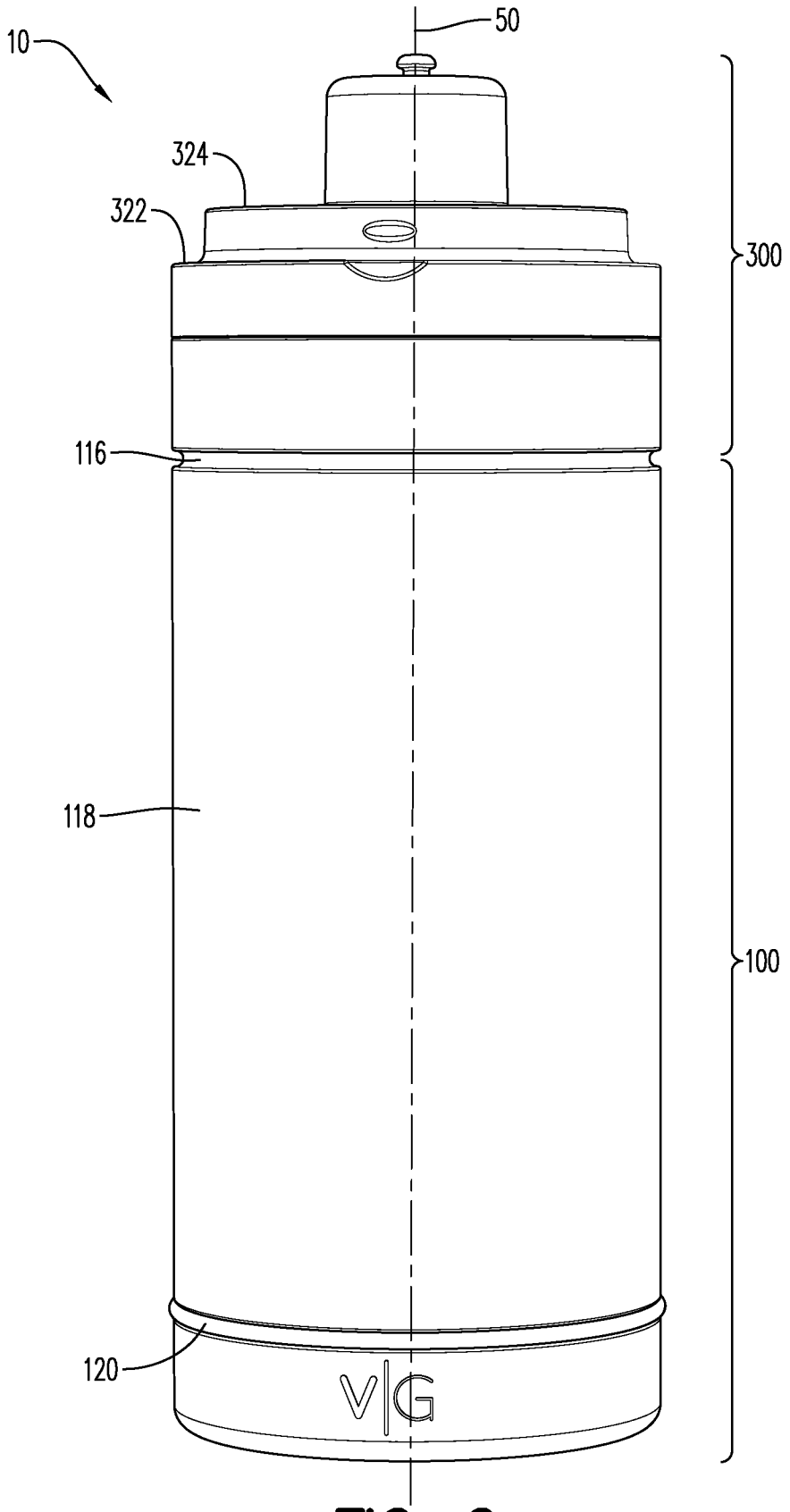
FIG. 2 is a perspective view of a container in an assembled configuration, according to an embodiment.

Various features, aspects, and advantages of the exemplary embodiments will become more apparent from the following detailed description, along with the accompanying drawings in which like numerals represent like components throughout the figures and detailed description. The various described features are not necessarily drawn to scale in the drawings but are drawn to aid in understanding the features of the exemplary embodiments.

The headings used herein are for organizational purposes only and are not meant to limit the scope of the disclosure or the claims. To facilitate understanding, reference numerals have been used, where possible, to designate like elements common to the figures.

DETAILED DESCRIPTION

Reference will now be made in detail to various exemplary embodiments. Each example is provided by way of explanation and is not meant as a limitation and does not constitute a definition of all possible embodiments. It is understood that reference to a particular "exemplary embodiment" of, e.g., a structure, assembly, component, configuration, method, etc. includes exemplary embodiments of, e.g., the associated features, subcomponents, method steps, etc. forming a part of the "exemplary embodiment".

For purposes of illustrating features of the embodiments, embodiments of a container 10 are introduced and referenced throughout the disclosure. FIGS. 1-28 each show various embodiments and components of the container 10. The container 10 includes outer body 100, an inner body 200 and a cover 300. In some embodiments, the container 10 may be configured and/or shaped for holding a beverage for drinking by a user.

Figure 3:
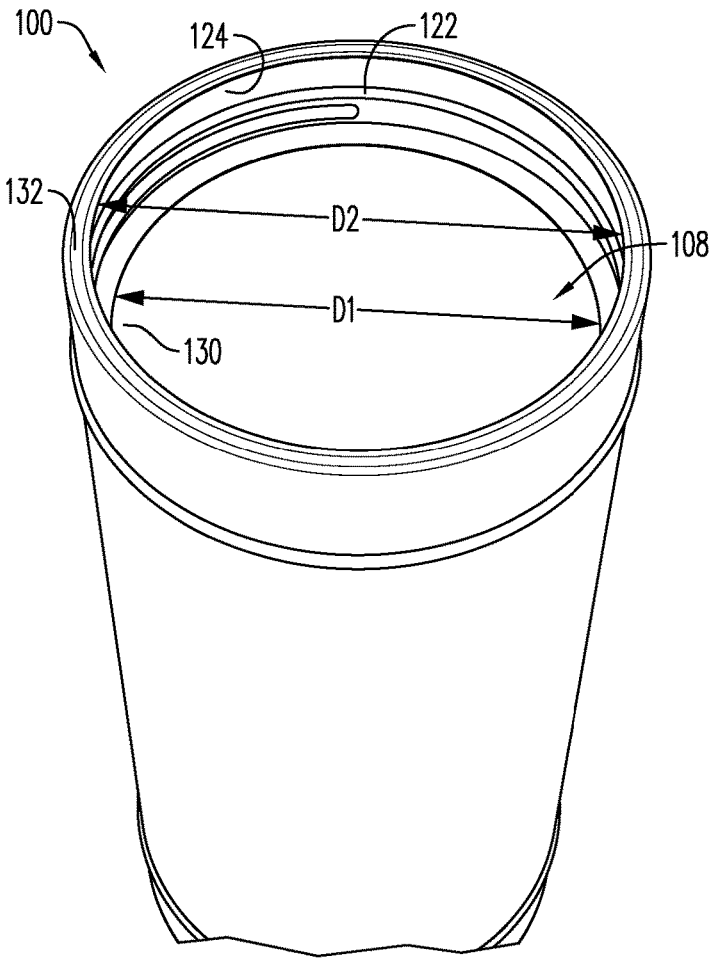
FIG. 3 is a top down, perspective view of an outer body of a container, according to an embodiment.

The outer body 100 includes an outer body cylindrical wall 102 extending in an axial direction 50 (FIG. 2) and an outer body end wall 104 provided at a first end 106 of the outer body cylindrical wall 102, also extending in the axial direction 50. According to an aspect, the outer body end wall 104 is integrally formed with the outer body cylindrical wall 102. As illustrated in FIG. 3, for example, the outer body cylindrical wall 102 and the outer body end wall may together define 104 an interior space 108. The interior space 108 may be configured for receiving objects, food items, beverages, and the like. In some embodiments, the interior space may be configured for receiving the inner body container, as discussed in more detail below.

According to an aspect, the outer body 100 further includes a groove 116 (FIG. 2 and FIG. 19) formed on an exterior surface 118 of the outer body cylindrical wall 102. A bumper 120 may be provided within the groove 116. The bumper 120 may serve to protect the container from being damaged when dropped or collided with another object. As seen for example in FIG. 19, the groove 116 may be one of a plurality of grooves, with a bumper 120 provided within each groove 116 of the plurality of grooves 116. The outer body 110 may be formed from plastic, metal (e.g. aluminum or stainless steel), and various other materials that may house and retain food items and beverages. In some embodiments, the outer body 100 may be formed of shatter-resistant material. According to an aspect, the outer body 100 is formed of a thermally insulating material.

The outer body 100 may include a first portion 130 axially having a first portion inner diameter D1 (e.g. of the interior space 108), and a second portion 132 having a second portion inner diameter D2 (e.g. of the interior space 108). The second portion inner diameter D2 is greater than the first portion inner diameter D1. As seen in FIG. 3, for example, the second portion 132 may include a thread 122. While a single continuous thread is shown, it is contemplated that multiple threads may be provided. According to an aspect, a plurality of interrupted or segmented threads are provided. In some embodiments, the outer diameter of the first portion 130 and second portion 132 may be substantially similar/constant.

Figure 28:
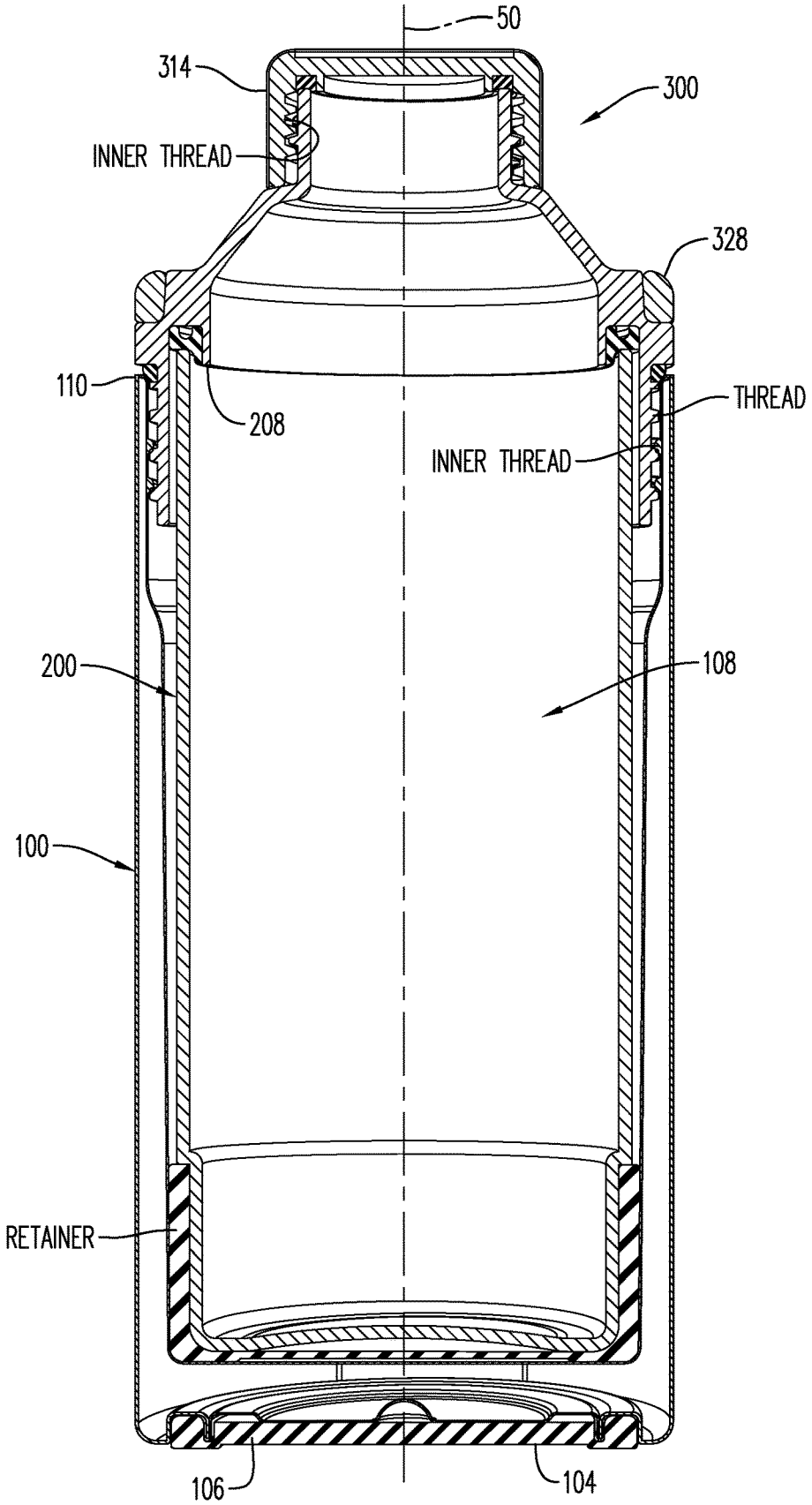
FIG. 28 is a cross-sectional view of a container, according to an embodiment.
Figure 29:
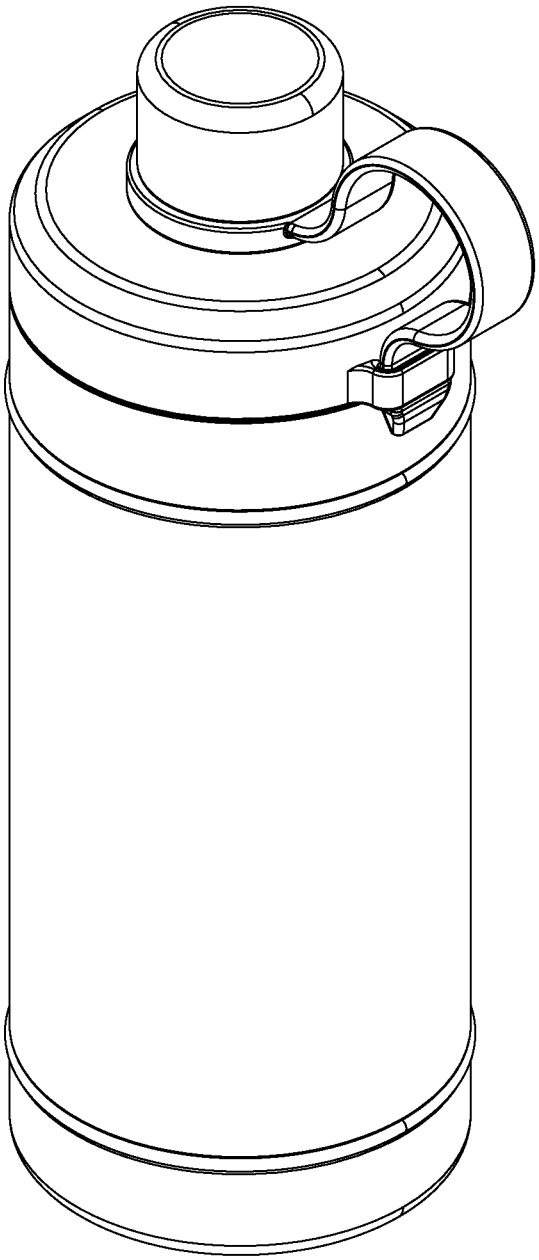
FIG. 29 illustrates a top perspective view of a container, according to an aspect.
Figure 30:
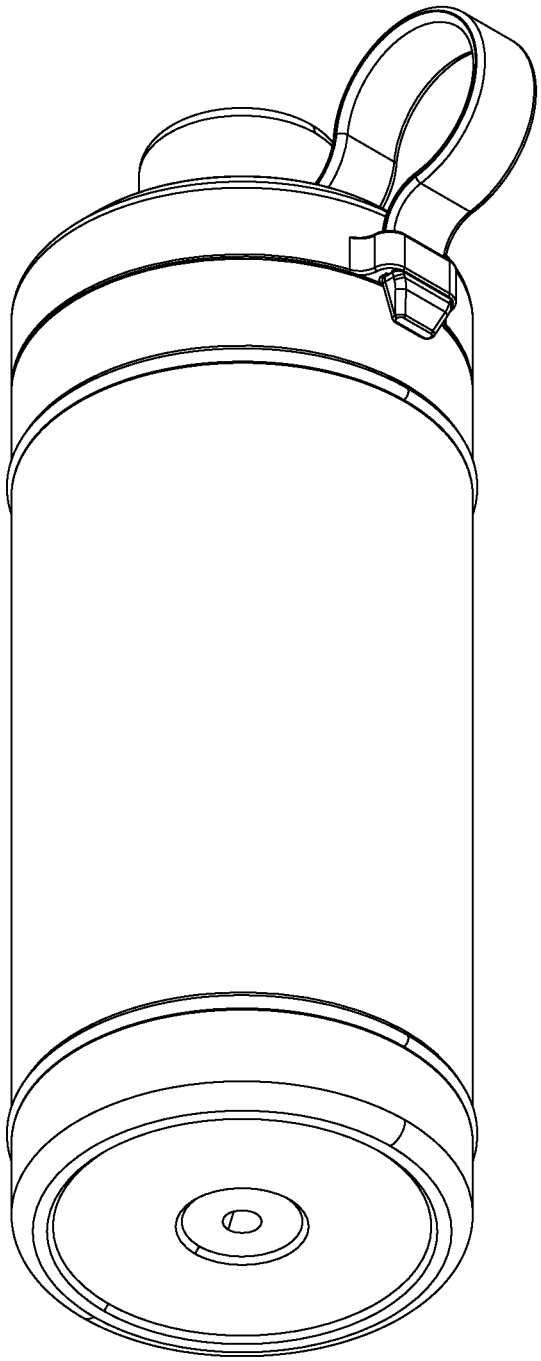
FIG. 30 illustrates a bottom perspective view of the container of FIG. 29.
Figure 31:
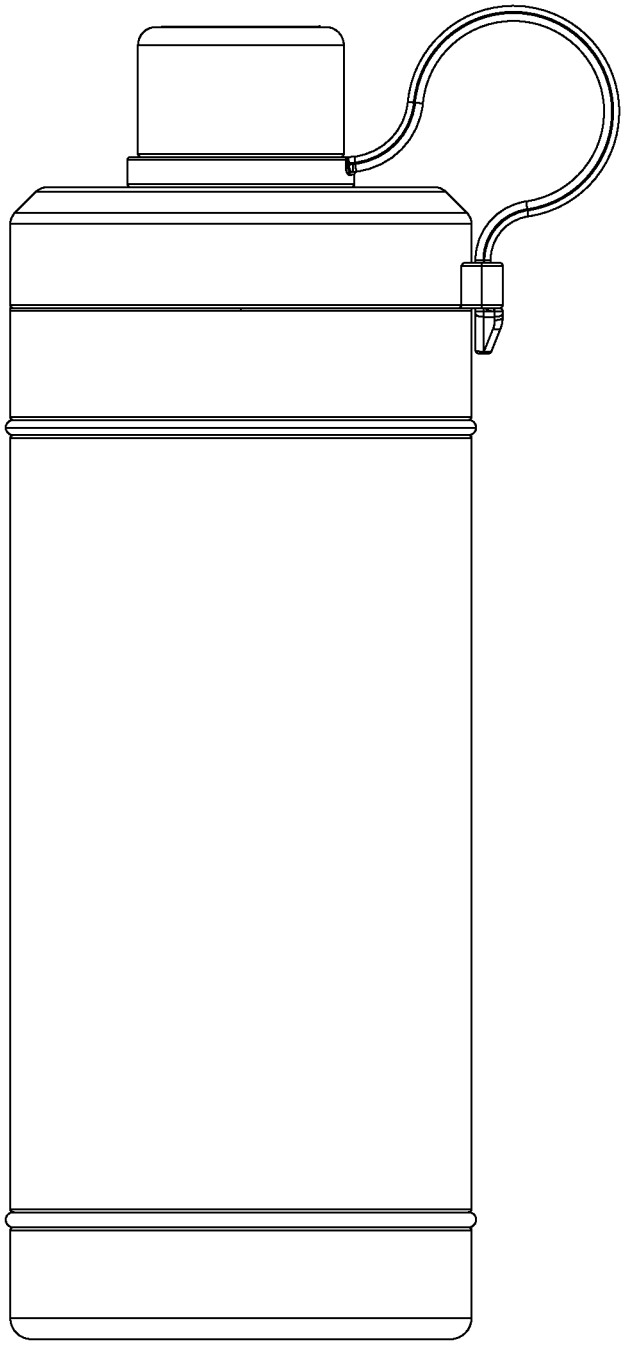
FIG. 31 illustrates a first side view of the container of FIG. 29.
Figure 32:
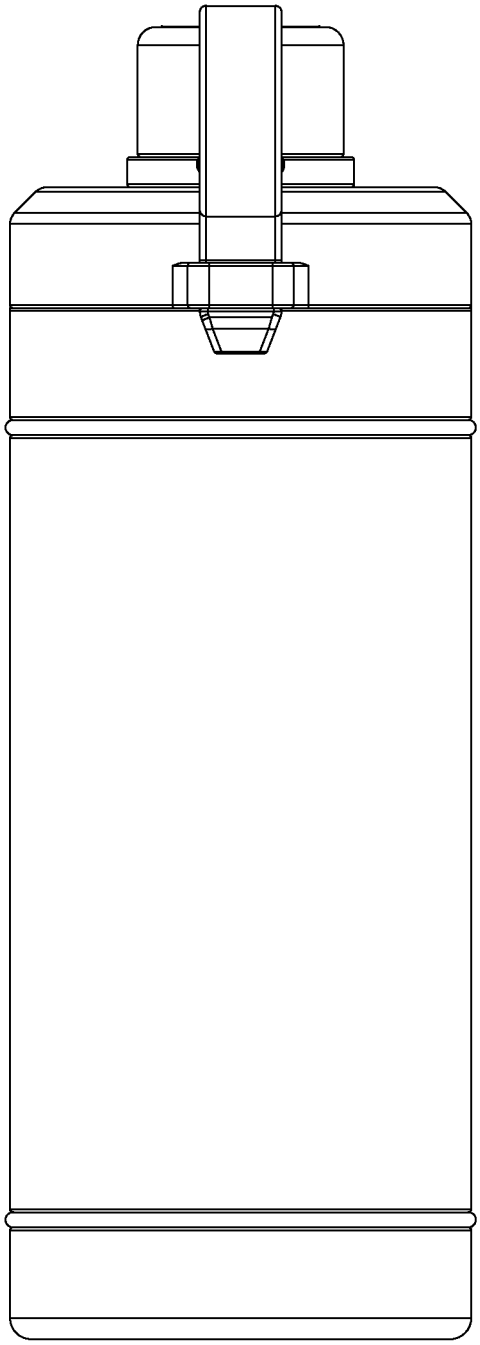
FIG. 32 illustrates a second side view of the container of FIG. 29.
Figure 33:
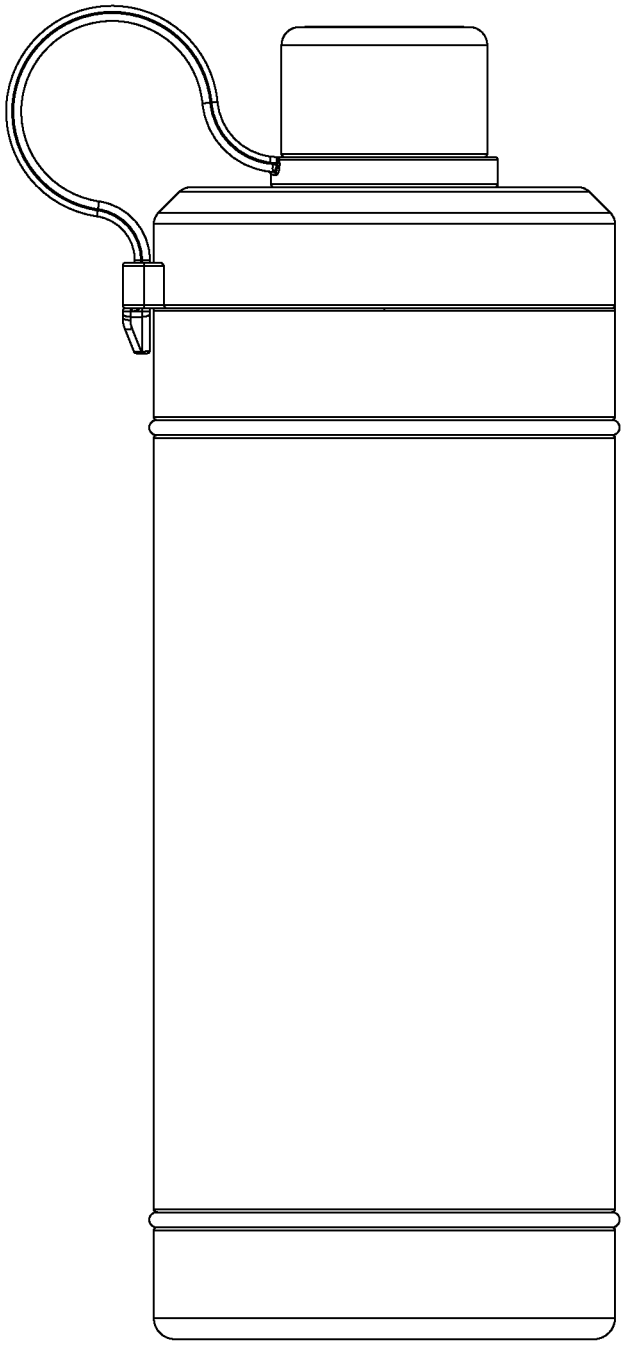
FIG. 33 illustrates a third side view of the container of FIG. 29.
Figure 34:
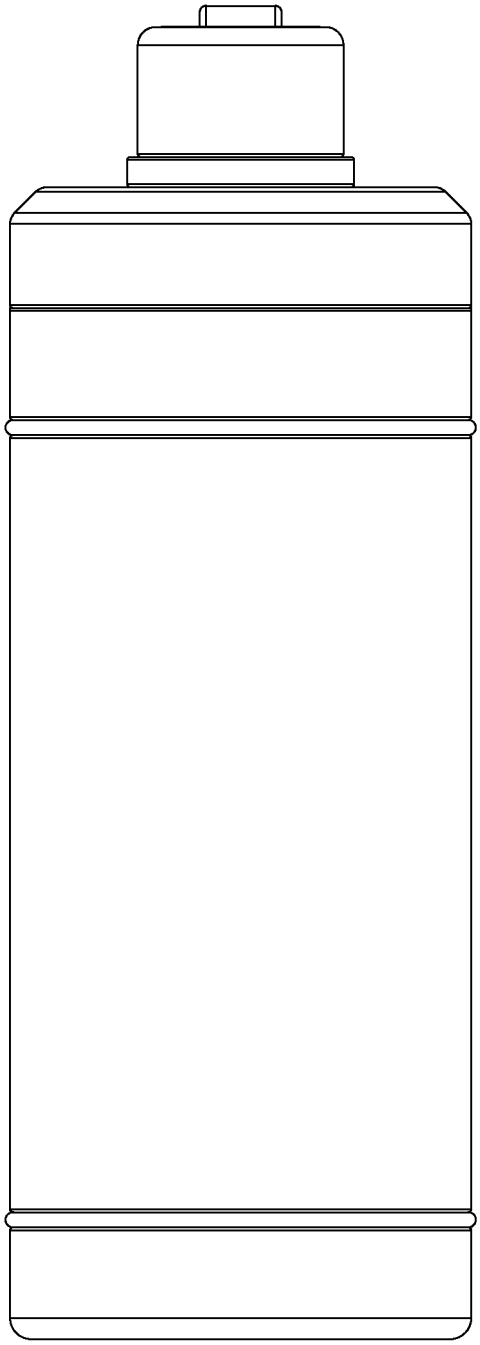
FIG. 34 illustrates a fourth side view of the container of FIG. 29.
Figure 35:
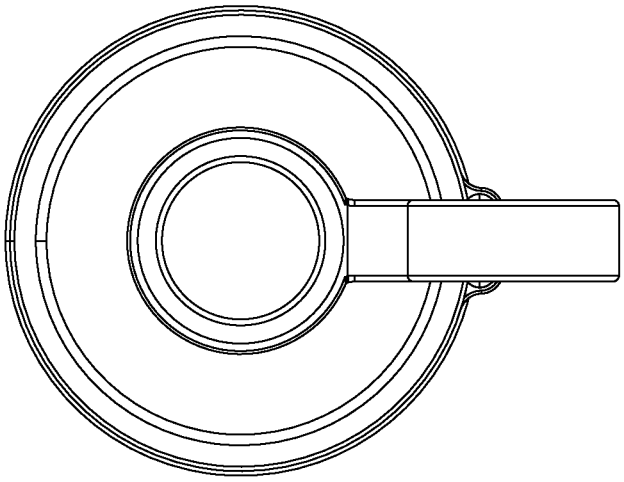
FIG. 35 illustrates a top view of the container of FIG. 29.
Figure 36:
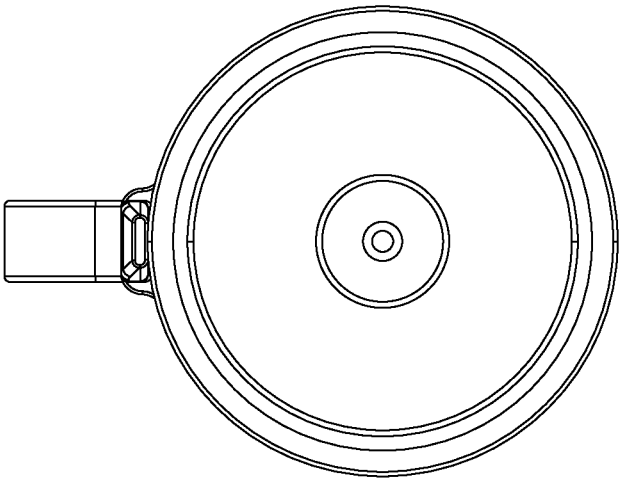
FIG. 36 illustrates a bottom view of the container of FIG. 29.
Figure 37:
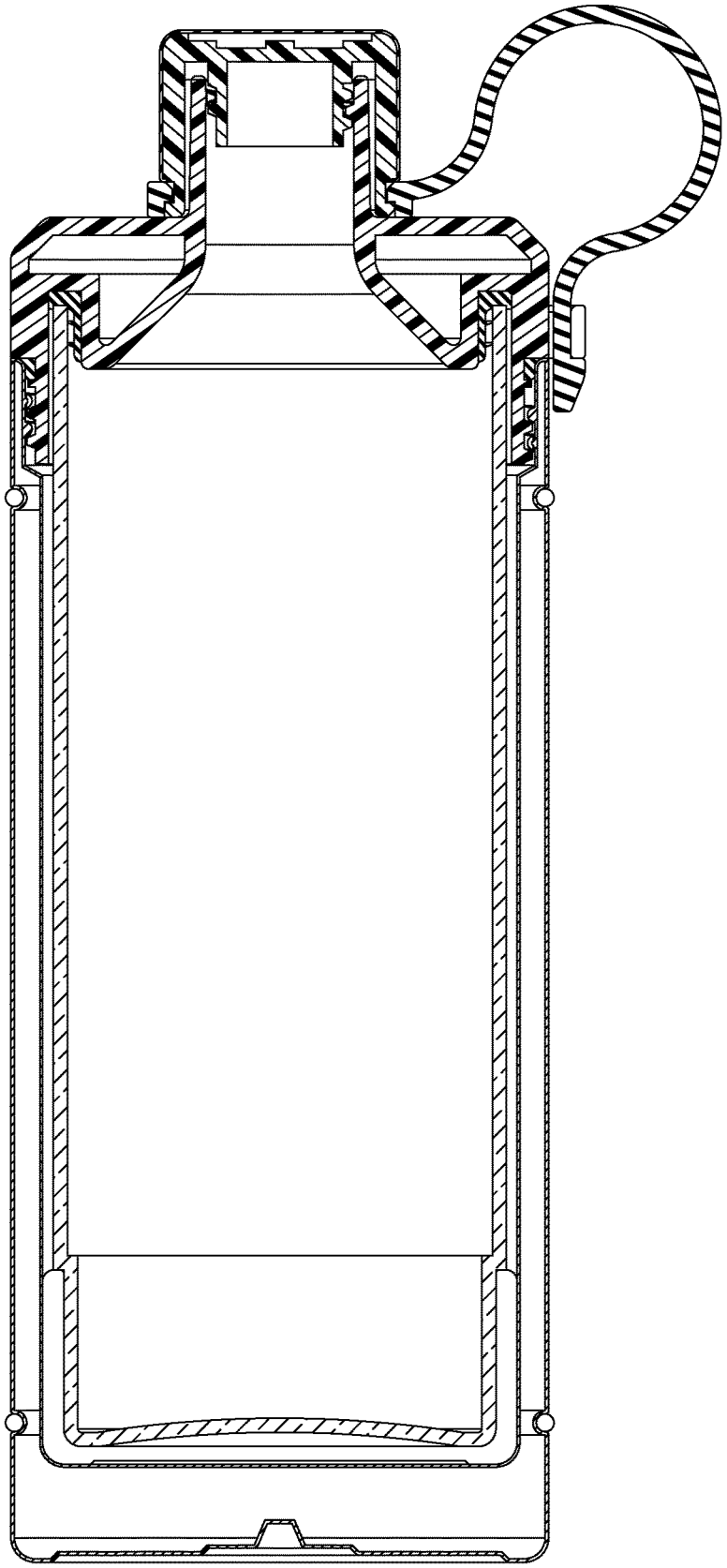
FIG. 37 illustrates a cross-section view of the container of FIG. 29.
Figure 38:
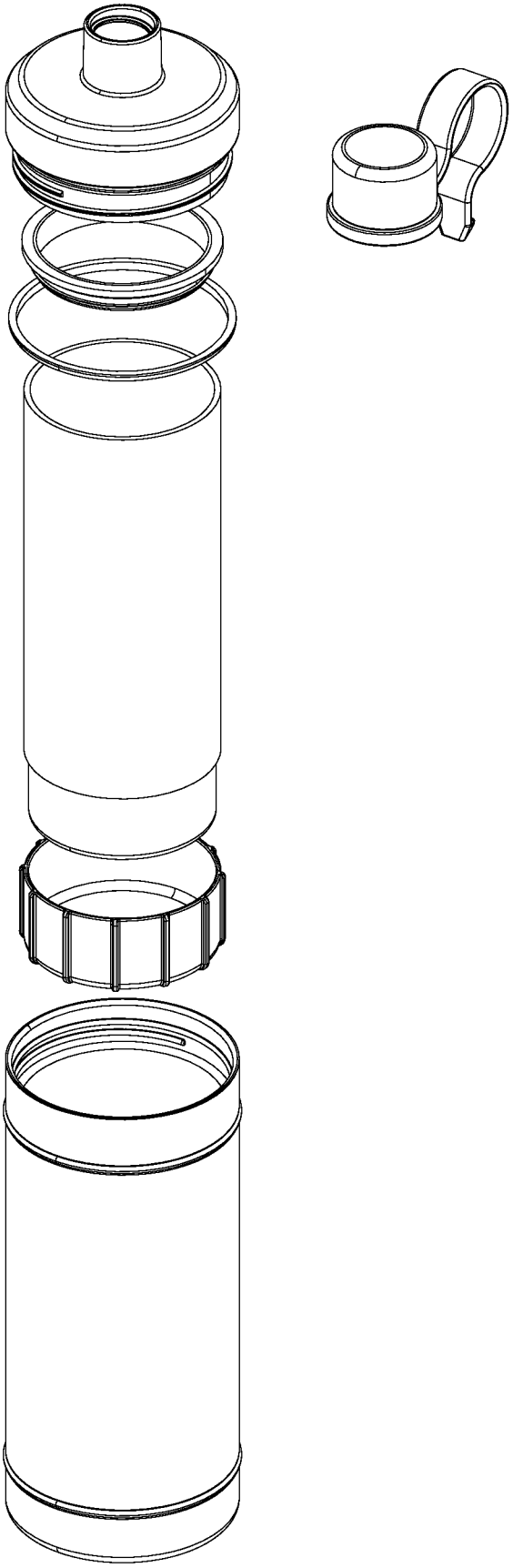
FIG. 38 illustrates an exploded view of the container of FIG. 29.
Figure 39:
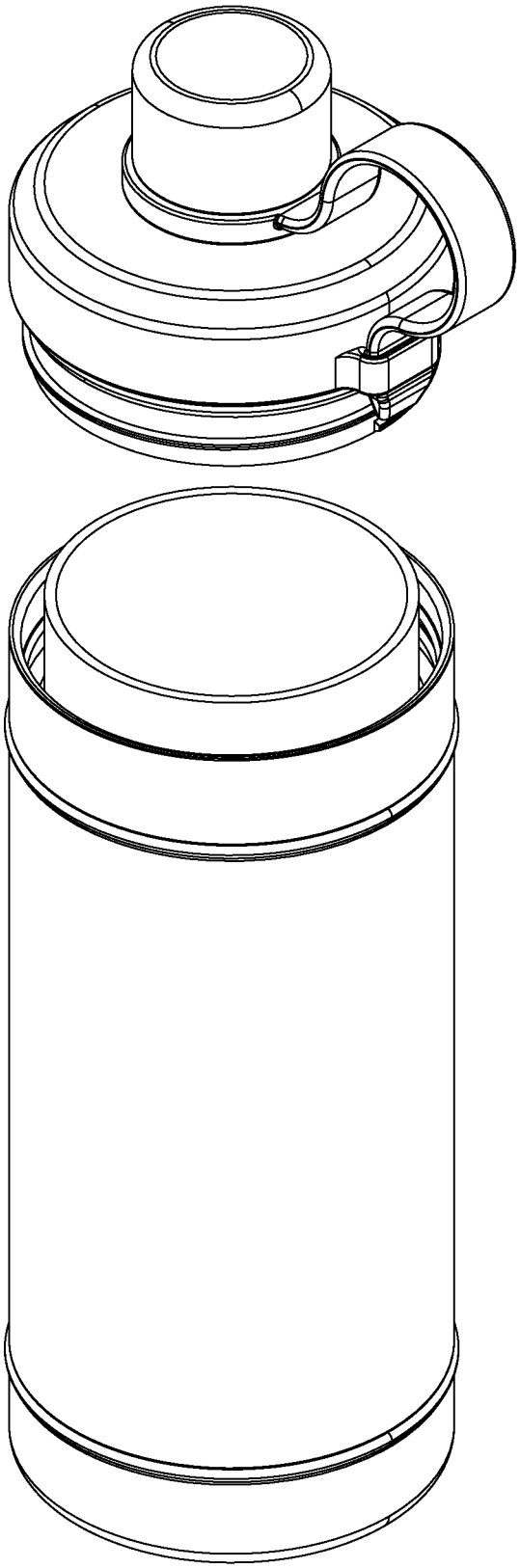
FIG. 39 illustrates a top perspective view of the container of FIG. 29, with the cover removed.
Figure 40:
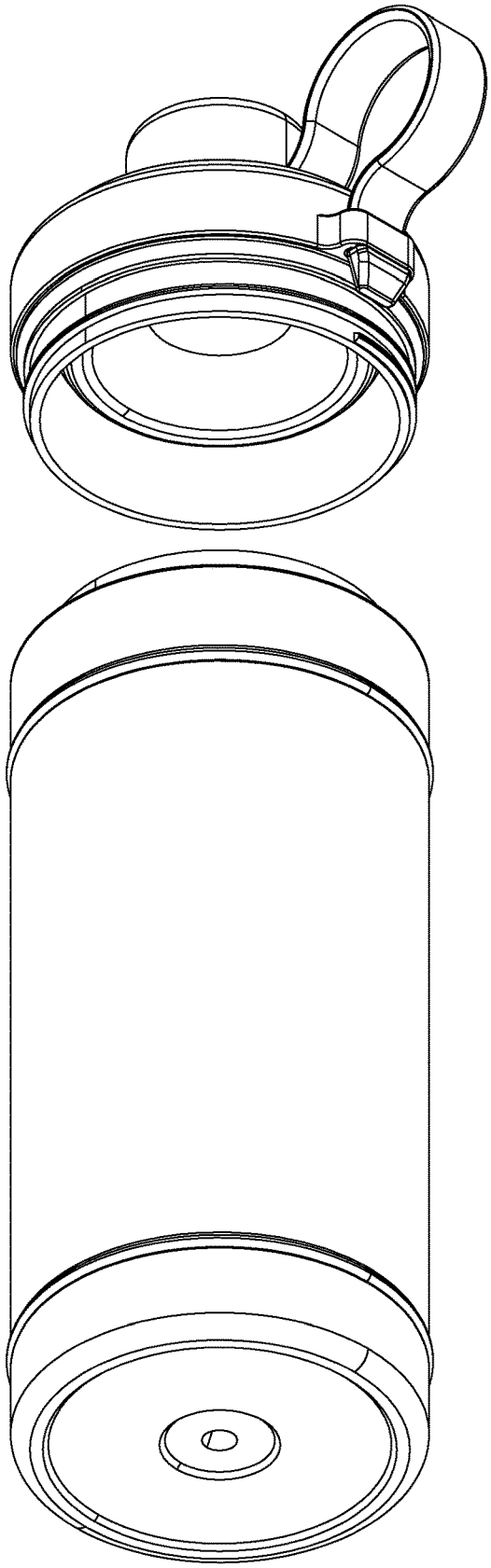
FIG. 40 illustrates a bottom perspective view of the container of FIG. 39.
Figure 44:
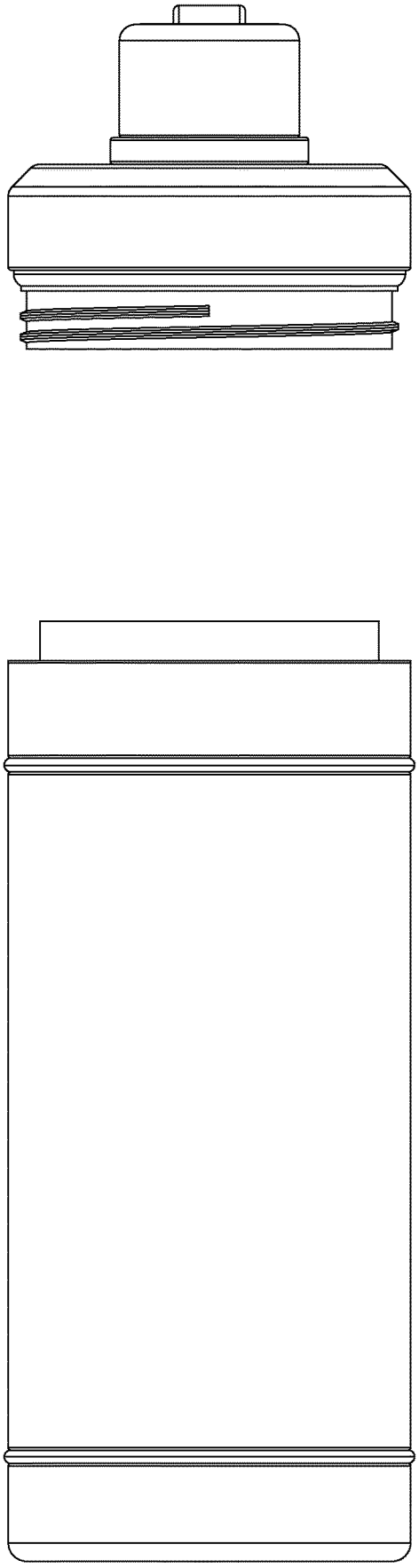
FIG. 44 illustrates a fourth side view of the container of FIG. 39.
Figure 45:
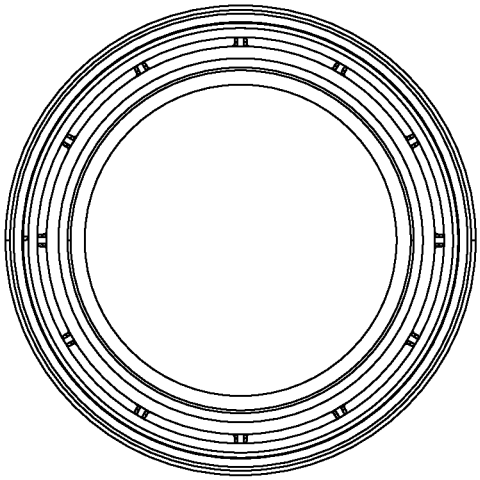
FIG. 45 illustrates a top view of the container of FIG. 39, with the cover removed.
Figure 46:
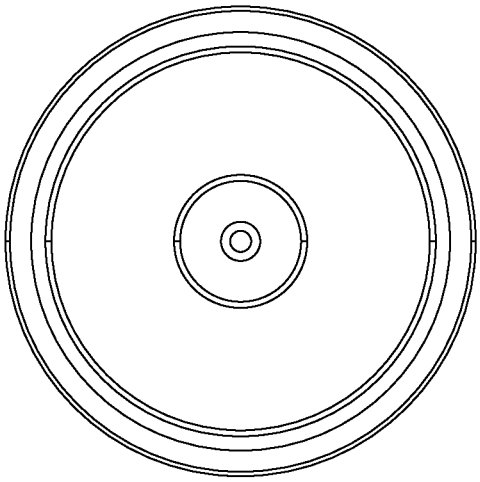
FIG. 46 illustrates a bottom view of the container of FIG. 45.

The outer body 100 may be insulated. According to an aspect, the outer body 100 is vacuum-insulated. According to an aspect and as seen for example, in FIG. 5 and FIG. 19, the outer body cylindrical wall 102 may include an outer wall 140 extending in the axial direction and an inner wall 142 extending in the axial direction 50. FIG. 28 shows a similar arrangement. According to an aspect, the outer wall 140 and the inner wall 142 are spaced apart from each other in a radial direction of the outer body cylindrical wall 102. In this configuration, a space 144 may be formed between the outer wall 140 and the inner wall 142. The space 144 may be substantially evacuated of air. The inner wall 142 and the outer wall 140 may be sealed together, to form a sealed space therebetween.

In an embodiment and as illustrated in FIG. 1, FIG. 13, FIGS. 21-23 and FIG. 26, the outer body 100 includes a facet 150 formed on an outer surface of the outer body cylindrical wall 102. The facet 150 may be configured as a depressed or separately contoured area formed in the outer surface of the outer body cylindrical wall 102. The outer body 100 may include multiple facets 150 formed on the outer surface of the outer body cylindrical wall 102, with a second facet being displaced 180 degrees from a first facet in a circumferential direction of the outer body cylinder wall. According to an aspect, a facet protrusion (ex: tactile members, raised portions, patterns or symbols) 154 may extend from the facet 150.

The inner body 200 may be provided concentrically within the interior space 108 of the outer body 100 (as seen, for instance, in FIG. 10, FIG. 13, FIG. 19, FIG. 26 and FIG. 28). For example, the inner body 200 may be configured to be concentrically disposed within the interior space 108 of the outer body 100. In some embodiments, the inner body 200 may be configured to be removably disposed within the outer body 100 (e.g. removably received in the interior space 108 of the outer body 100). For example, the inner body 200 may be configured to be easily removed (e.g. detached and/or attached) from the outer body 100, without any significant disassembly/reassembly steps and/or hardware. In some embodiments, the inner body 200 may be removed from and/or inserted within the outer body 100 without the use of tools. For example, when the cover 300 is removed, the inner body 200 may simply be slid out of the outer body 100 (and/or the retainer disposed therein), without any additional steps. According to an aspect, the inner body 200 includes an inner body cylindrical wall 202 extending in the axial direction 50, and an inner body end wall 204 provided at a first end 206 of the inner body cylindrical wall 202 also in the axial direction 50. According to an aspect, the inner body end wall 204 is integrally formed with the outer body cylindrical wall 102. The inner body cylindrical wall 202 and the inner body end wall 204 may together define a cavity, which may be configured to retain food and/or beverage. The inner body 200 may be formed from a variety of materials, such as metals, plastics and any other materials for housing food and beverage items. In some embodiments, the inner body 200 may be formed of a less durable material than the outer body 100, for example a more shatter-prone material). In some embodiments, the inner body 200 may be formed of a material less likely to leach and/or retain flavor or smell than the outer body material 100. In some embodiments, the inner body 200 may be formed of a material that is dishwasher safe. According to an aspect, the inner body 200 is formed of glass.

In some embodiments, the inner body 200 may be removable from the outer body 100 for cleaning. The inner body 200 may be removably secured within the outer body 100. For example, the base (e.g. first end) of the inner body 200 may be secured by a retainer 1905 (e.g. friction fit) and/or a corresponding/mating lock protrusion/lock recess, and/or the top (e.g. second end) may be secured by the cover 300. In some embodiments, the inner body 200 may be secured in the outer body 100 (e.g. interior space 108) in a manner providing shock-absorption (e.g. to minimize transference of impact shock which might break or damage the inner body 200).

The cover 300 is detachably coupled to the inner body 200 and the outer body 100. According to an aspect, the cover 300 includes a cover plate 302, and an inner cover cylinder 304 extending from the cover plate 302 to a first side of the cover 300 in the axial direction 50. The cover 300 may further include an outer cover cylinder 306 concentric with the inner cover cylinder 304 and extending from the cover plate 302 to the first side in the axial direction 50. According to an aspect, the cover plate 302 further includes a first cover plate surface 322 and a second cover plate surface 324 space apart from the first cover plate surface 322. The second cover plate surface 324 may have a radius smaller than a radius of the first cover plate surface 322. A cover plate wall 326 extends from the second cover plate surface 324 to the first cover plate surface 322. In some embodiments, the cap 300 may have an outer diameter which is substantially the same as the outer diameter of the outer body 100. For example, the outer diameter of the first cover plate surface 322 may be substantially the same as the outer diameter of the outer body 100, so that when the cap 300 is disposed on the outer body 100, it is flush to form an integrated container 10 with an approximately constant outer diameter. In some embodiments, the outer diameter of the outer cover cylinder 306 may be less than the inner diameter of the outer body 100 (e.g. the interior space 108), for example so that the outer cover cylinder 306 may extend into the interior space 108 of the outer body 100 when it is in place atop the outer body 100. In some embodiments, both the inner cover cylinder 304 and the outer cover cylinder 306 may be configured to extend into the interior space 108 of the outer body 100, when the cover 300 is attached atop the outer body 100

According to an aspect, a spout cylinder 310 extends from the cover plate 302 to a second side in the axial direction 50, opposite to the first side. A bore 312 extends through the spout cylinder 310 and the cover plate 302. A spout projection 334 may project or otherwise extend inward, towards the bore 312, from an inner surface of the spout cylinder 310. The spout projection 334 may extends for less than a total circumference of the inner surface of the spout cylinder 310.

Figure 7:
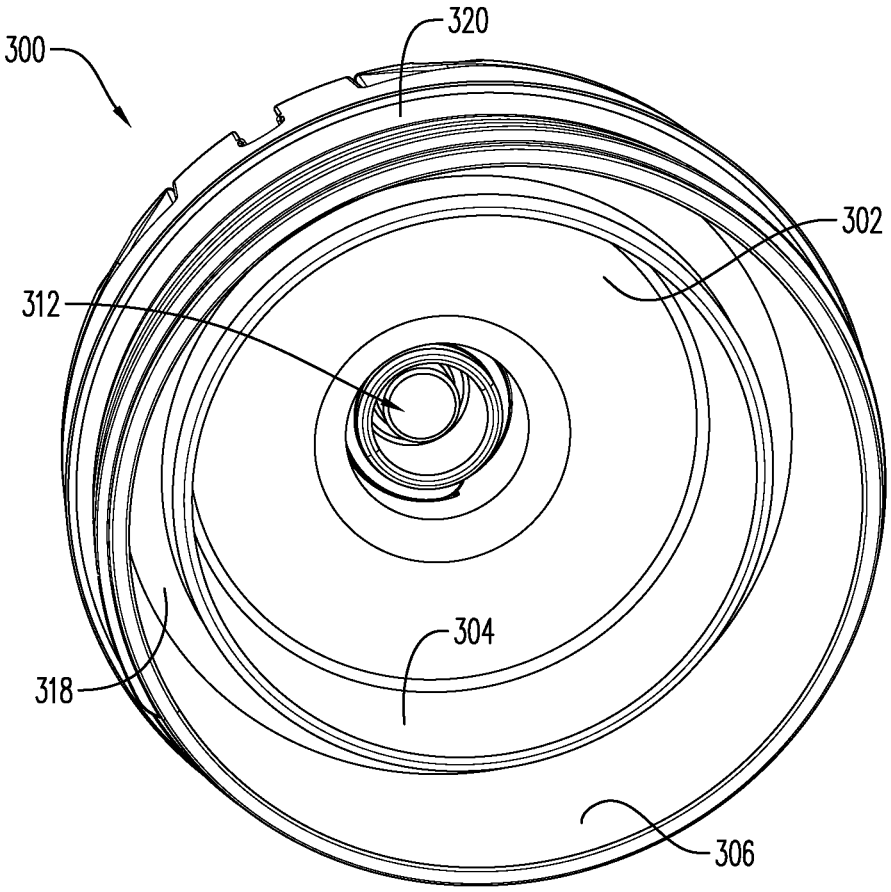
FIG. 7 is a bottom view of a cover, according to an embodiment.
Figure 8:
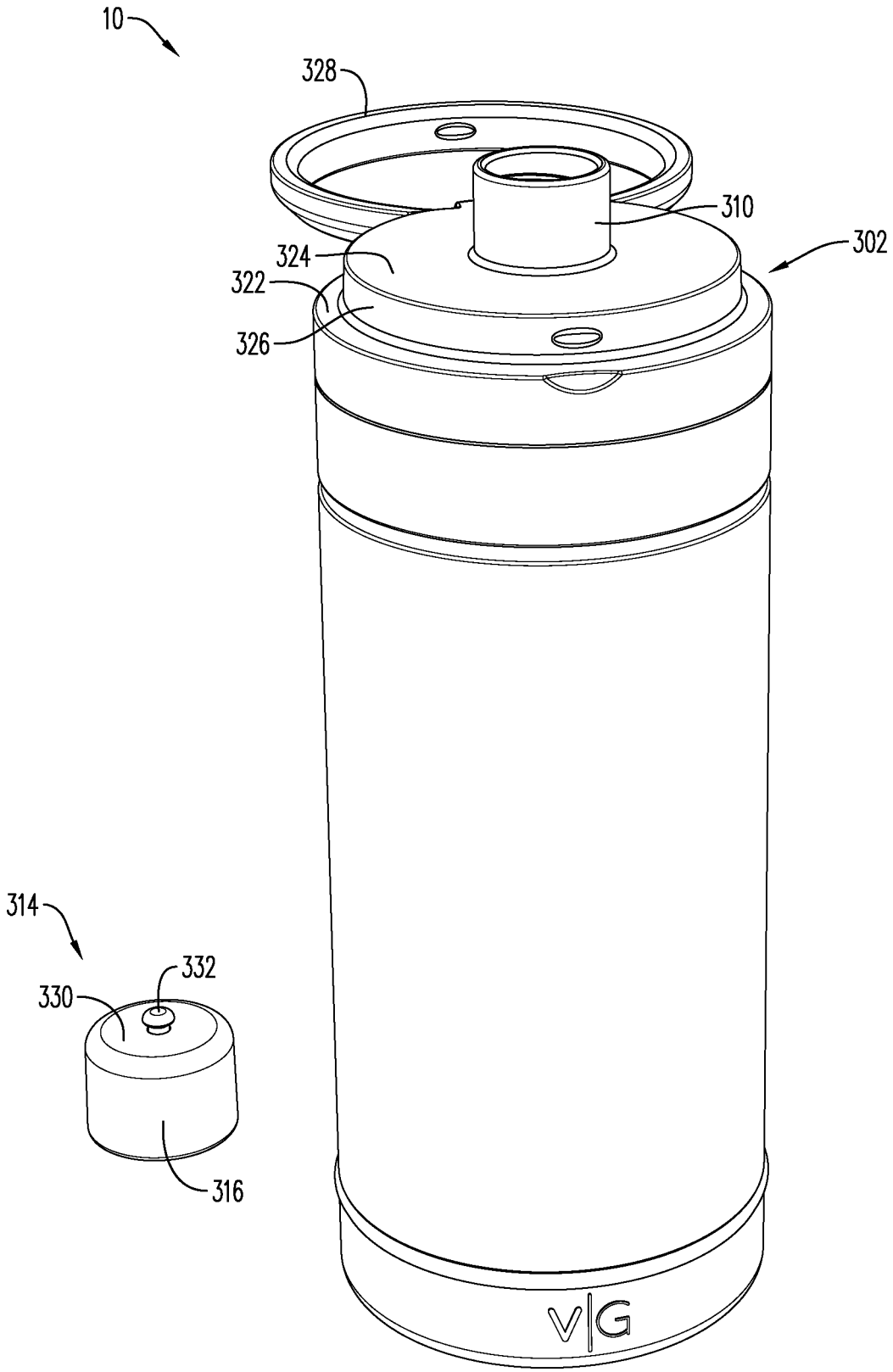
FIG. 8 is perspective view of a container, illustrating a cap removed from a cover and a handle arranged in an open configuration, according to an embodiment.
Figure 9:
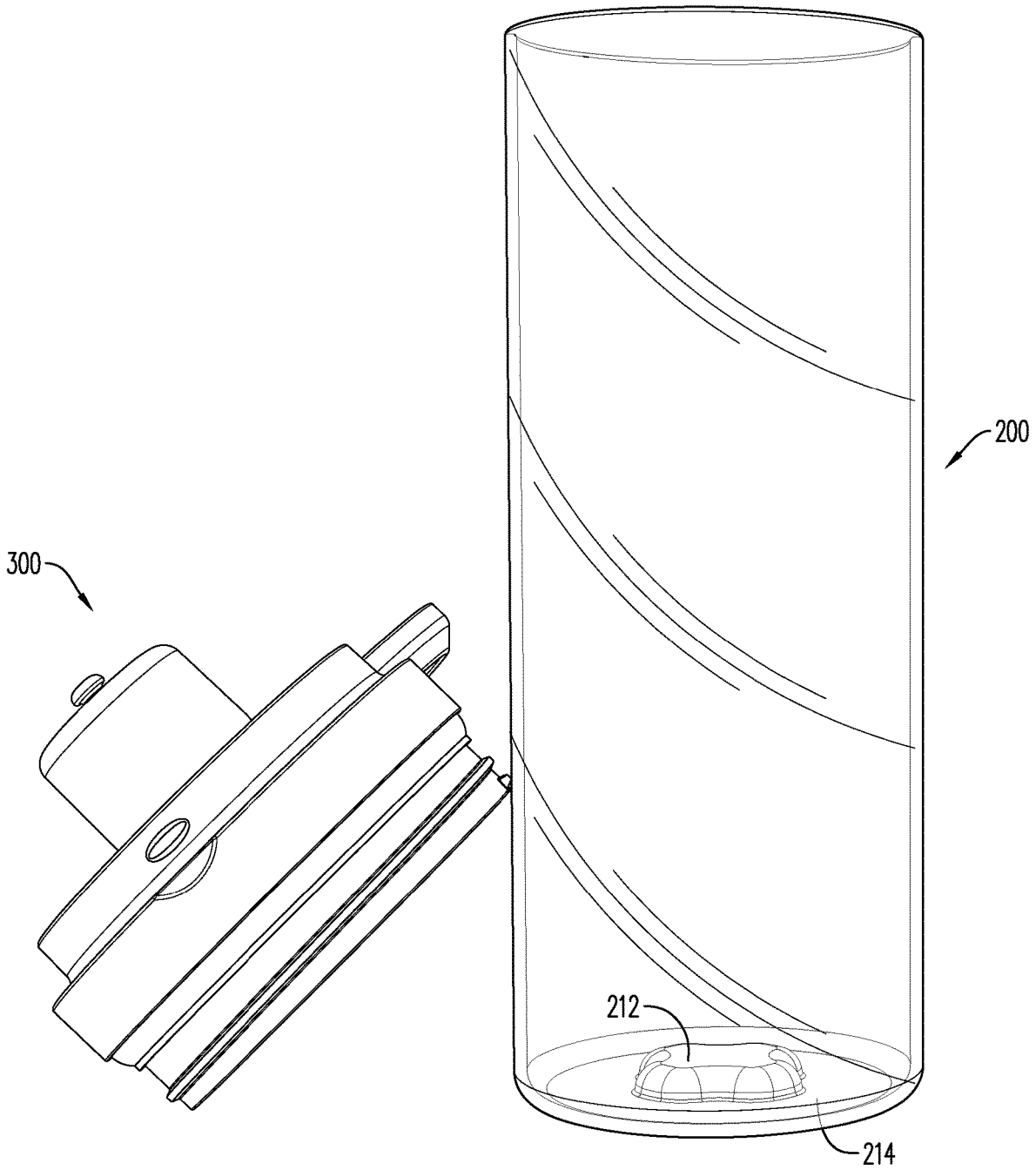
FIG. 9 is a side view of a cover and a side view of an inner body of a container, according to an embodiment.
Figure 10:
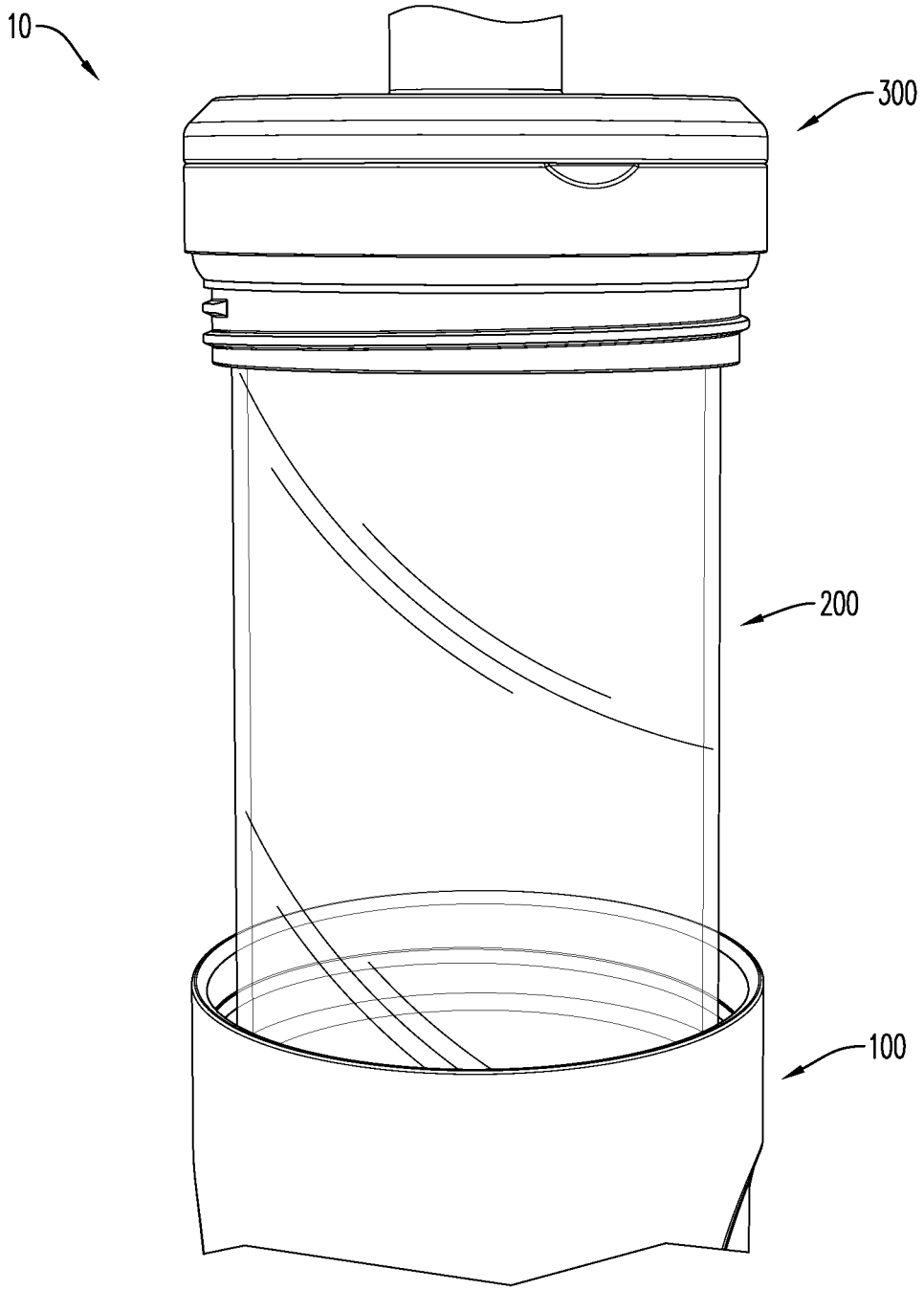
FIG. 10 is a perspective view of a container, illustrating a cover assembled to an inner body for insertion into an outer body, according to an embodiment.
Figure 11:
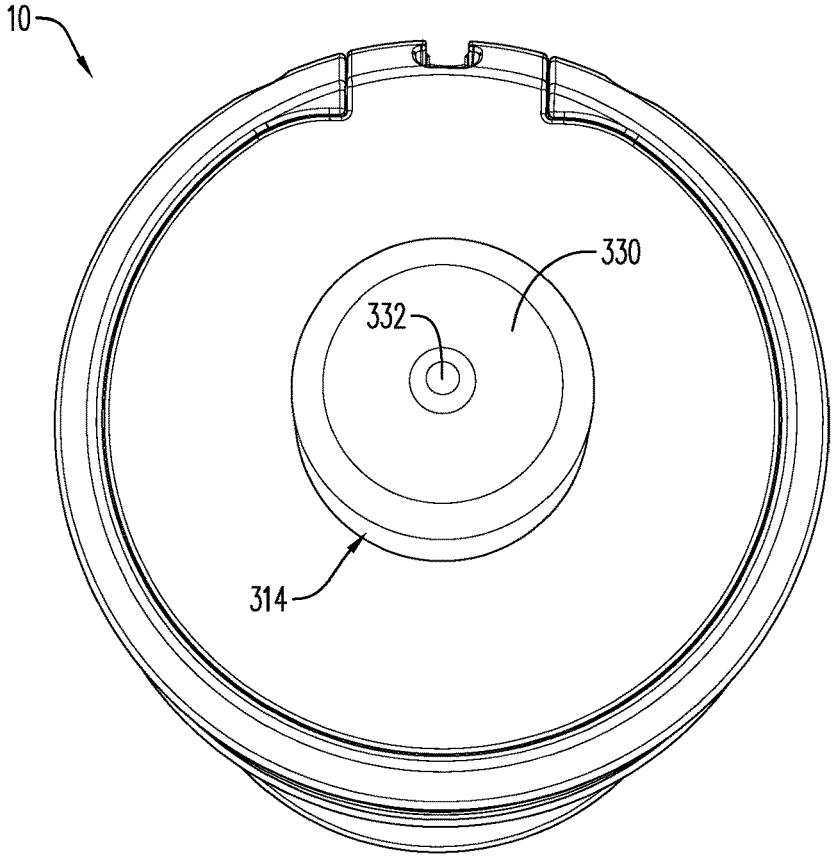
FIG. 11 is a top view a container, illustrating a cap and cover in an assembled configuration and the handle in a closed configuration, according to an embodiment.

As illustrated in FIG. 7 the container 10 may include inner and outer seal members 318, 320. The inner seal member 318 may be provided between the inner cover cylinder 304 and the outer cover cylinder 306 in a radial direction (FIG. 7). In some embodiments, the inner seal member 318 may be disposed adjacent to the cover plate 302, for example contacting the cover plate 302. In some embodiments, the inner seal member 318 may be configured to seal atop the lip/rim/top surface of the inner body 200, when the cover 300 is in place. In some embodiments, the inner seal member 318 may be L-shaped or u-shaped, for example having a portion contacting the cover plate 302, a portion extending along the inner cover cylinder 304, and/or a portion extending along the outer cover cylinder 306. The outer seal member 320 may be provided on an outer surface of the outer cover cylinder 306 (FIG. 1). In some embodiments, the outer seal member 320 may be configured to seal to the inner surface of the outer body 100.

As seen, for example in FIG. 1, a length of the inner body 200 in the axial direction may be substantially the same as a length of the outer body 100 in the axial direction 50. In some embodiments, the length of the inner body 200 may be greater than the length of the outer body 100. When the inner body 200 is positioned within the interior space of the outer body 100, as assembled, an open/second end 208 of the inner body 200 extends beyond (i.e., above or elevated) a second end 110 of the outer body 100. For example, the second end 208 of the inner body 200 may extend approximately ¼ inch, ½ inch, % inch, ¼-½ inch, ¼-¾ inch, ½-¾ inch, or less than 1 inch beyond the second end 110 of the outer body 100.

Figure 19:
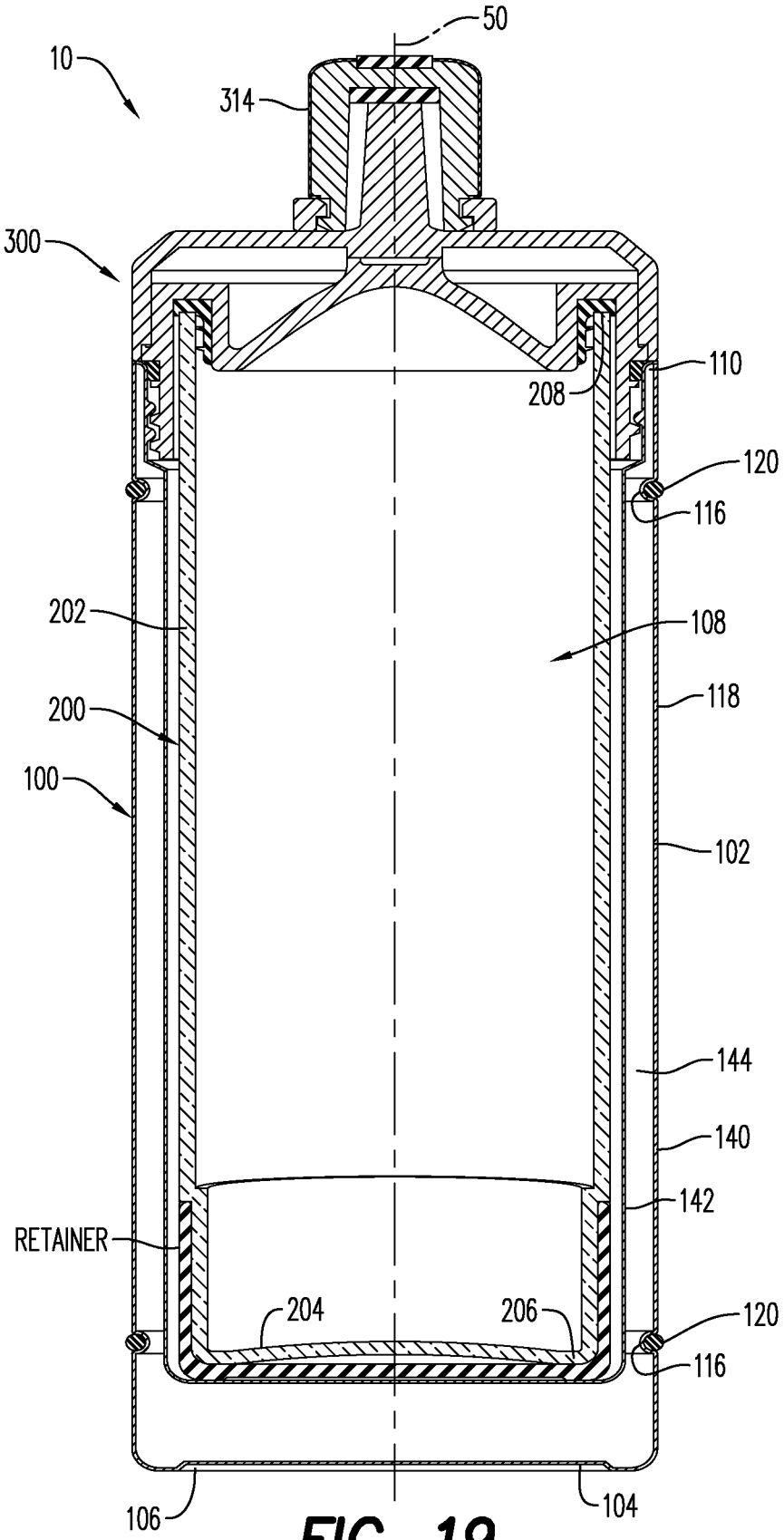
FIG. 19 is a cross-sectional view of a container, according to an embodiment.
Figure 20A:
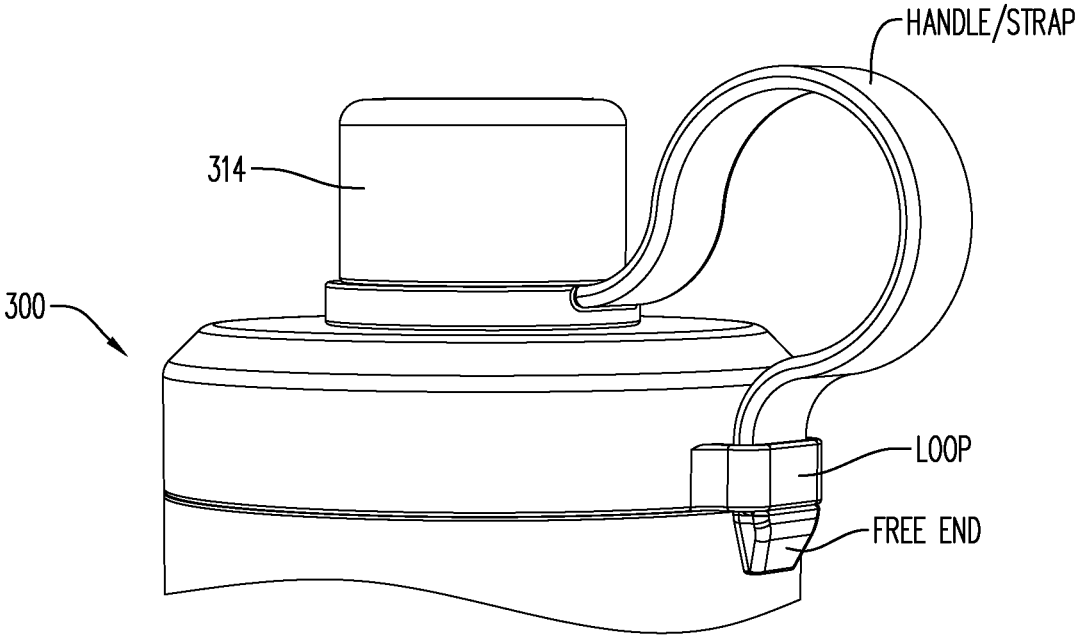
FIGS. 20A and 20B are a perspective views of a cover, according to an embodiment.
Figure 20B:
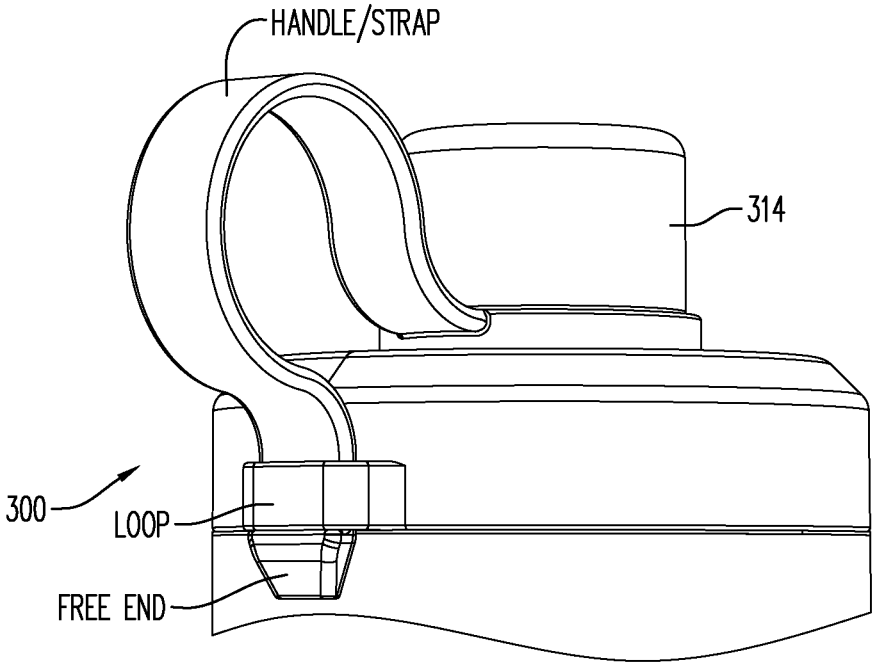
Figure 21:
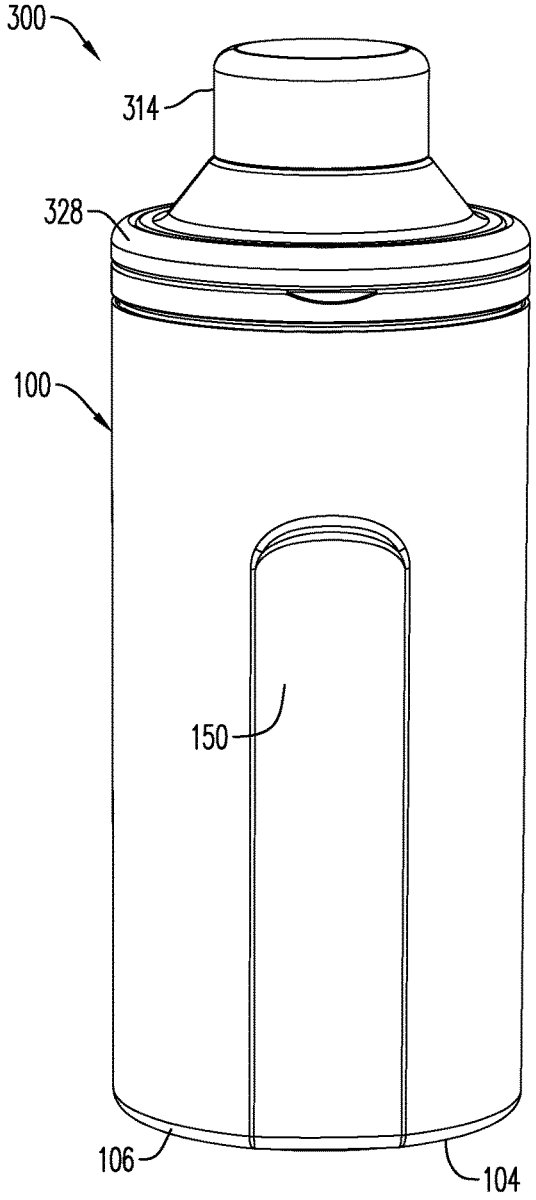
FIG. 21 is front view of a container, according to an embodiment.
Figure 22:
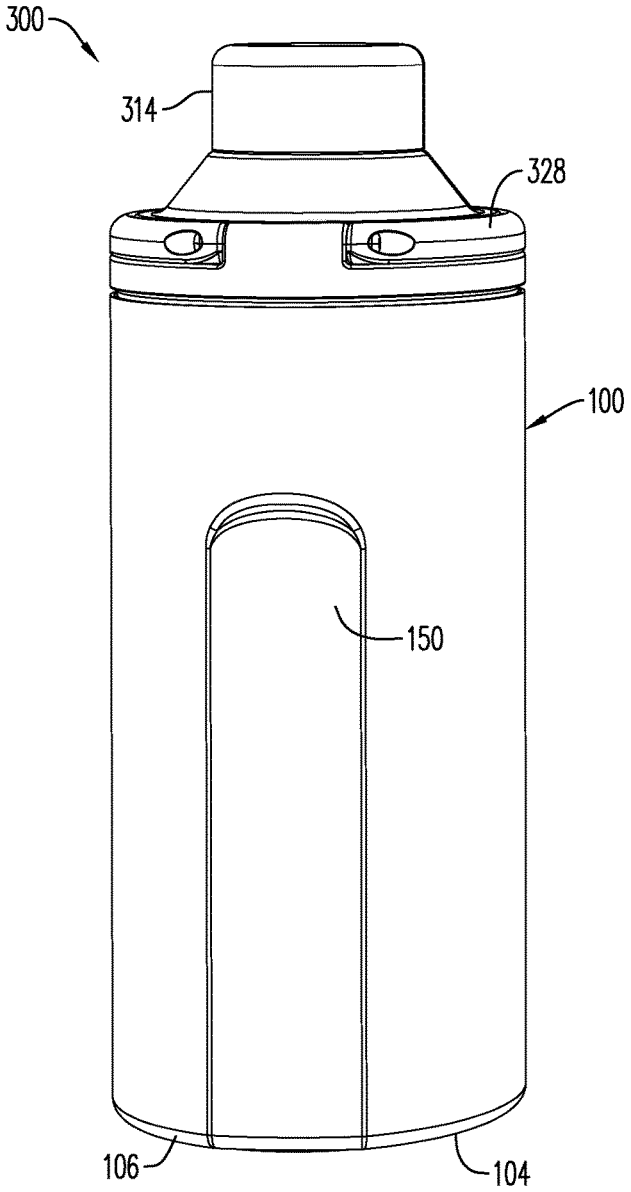
FIG. 22 is a rear view of the container of FIG. 21, according to an embodiment.
Figure 23:
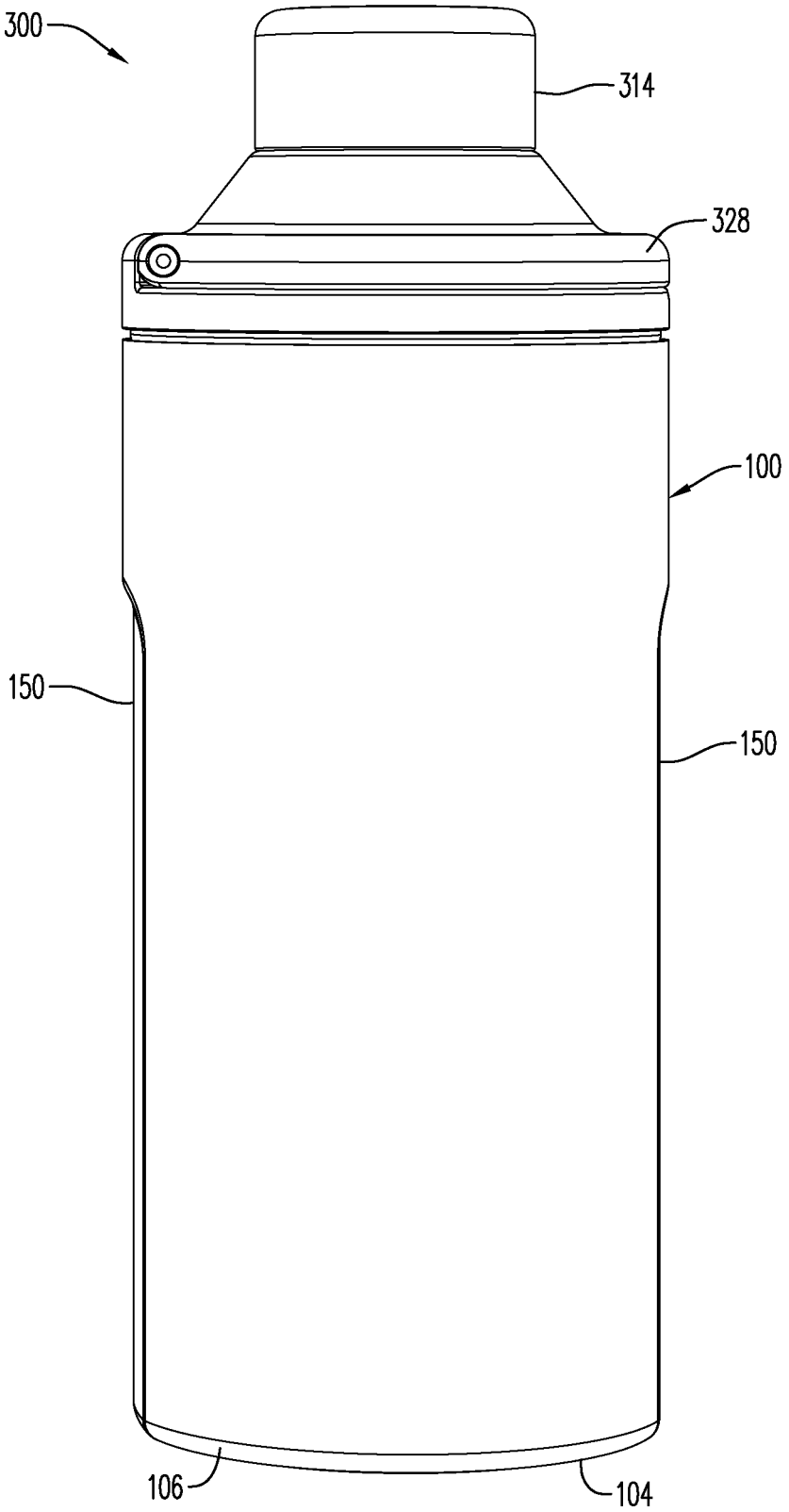
FIG. 23 is a side view of the container of FIG. 21, according to an embodiment.
Figure 24:
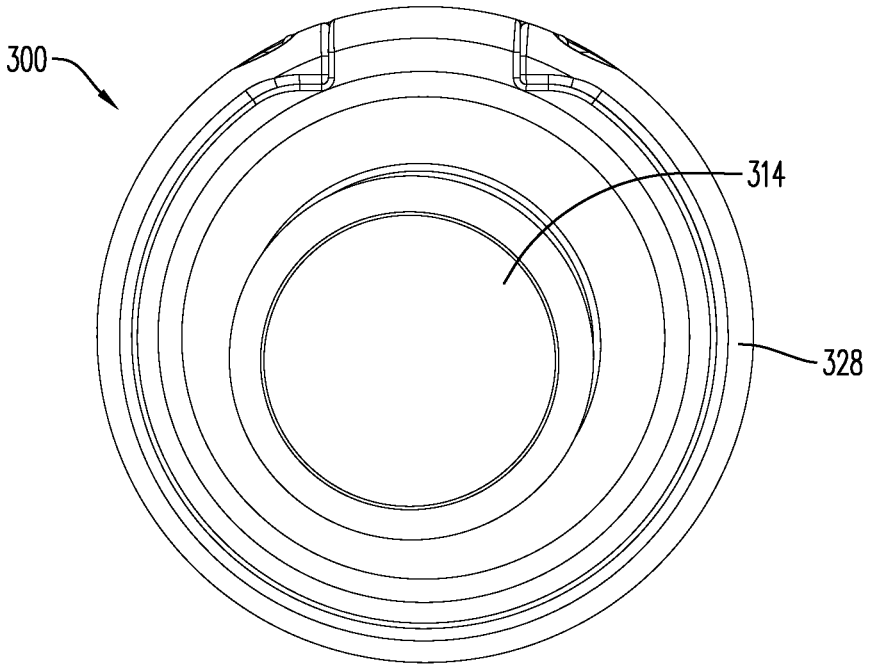
FIG. 24 is top view of a cover, according to an embodiment.
Figure 26:
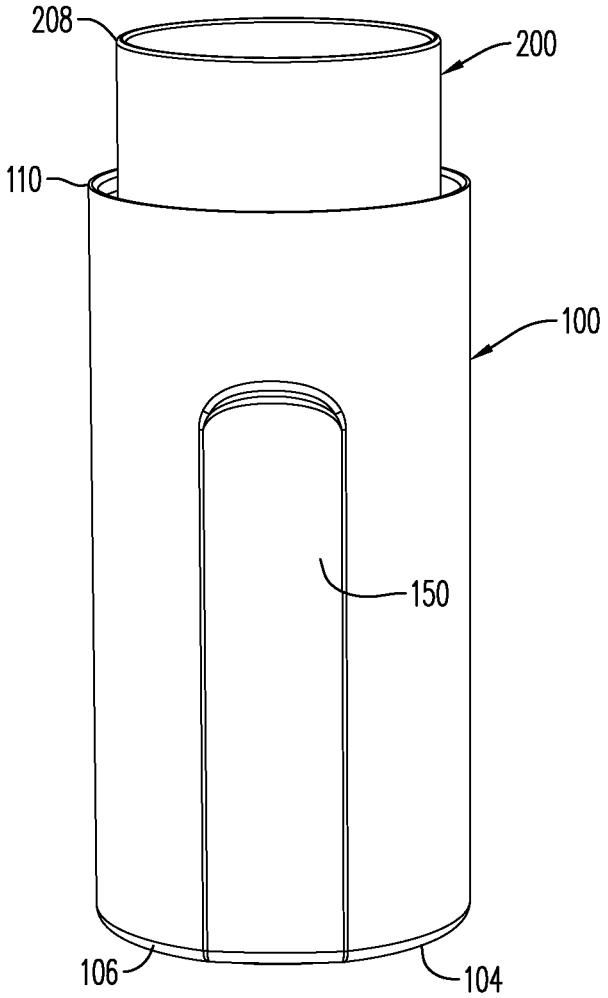
FIG. 26 is a side view of a container, illustrating an inner body positioned in an outer body, according to an embodiment.

According to an aspect, the length of the inner body 200 in the axial direction 50 is greater than the length of the outer body 100 in the axial direction 50. When the inner body 200 is positioned in the outer body 100, the second end 208 of the inner body 200 extends outside of or beyond the interior space 108 of the outer body 100. In some embodiments, the second end 208 of the inner body 200 includes a sipping portion, configured for interaction with a user's mouth (e.g. when the cover 300 is removed). According to an aspect, the second end 208 of the inner body 200 is opposite to the first end 206 of the inner body 200 in the axial direction 50 and is displaced in the axial direction 50 from the second end 110 of the outer body 100. The second end 110 of the outer body 100 is opposite to the first end 106 of the outer body 100 in the axial direction 50, and the second end 208 of the inner body cylindrical wall 202 is positioned between the inner cover cylinder 304 and the outer cover cylinder 306 in a radial direction perpendicular to the axial direction 50. In some embodiments, the outer diameter of the inner body 200 may be less than the inner diameter of the outer body 100, for example along the entire length of the inner body 200 and outer body 100. In some embodiments and as illustrated in FIGS. 19, 26 and 28, there may be a gap circumferentially around the inner body 100 when it is disposed within the outer body 200 (e.g. the inner body cylinder wall 202 may be spaced inward of the outer body cylinder wall 102). In some embodiments, the gap may extend the length of the inner body 200 and/or outer body 100, while in other embodiments, the gap may be located at least (e.g. only) along the top portion (e.g. in proximity to the second end) of the inner body cylinder wall 202 and/or the outer body cylinder wall 102. In some embodiments, the gap may be sized to allow passage of the outer cover cylinder 306 between the inner body 200 and the outer body 100, and in some embodiments the gap of such width (e.g. having a width similar to the width of the outer cover cylinder 306) may extend downward from the second end for a distance greater than the extension of the outer cover cylinder 306 (for example, at least ¼ of the length of the outer body 100, at least ⅓ of the length of the outer body 100, at least ½ of the length of the outer body 100, at least ⅔ of the length of the outer body 100, at least % of the length of the outer body 100, ¼-¾ the length of the outer body 100, ⅓-⅔ the length of the outer body, or the entire length of the outer body 100). In some embodiments, the gap may be configured to provide shock-protection to the inner body 200. In some embodiments, the gap may be approximately 1 millimeter, at least one millimeter, at least 2 millimeters, at least 3 millimeters, 1-3 millimeters, 1-2 millimeters, or 2-3 millimeters. In some embodiments, the gap between the inner body 200 and the outer body 100 may be approximately uniform radially around the circumference of the inner body 200.

Figure 4:
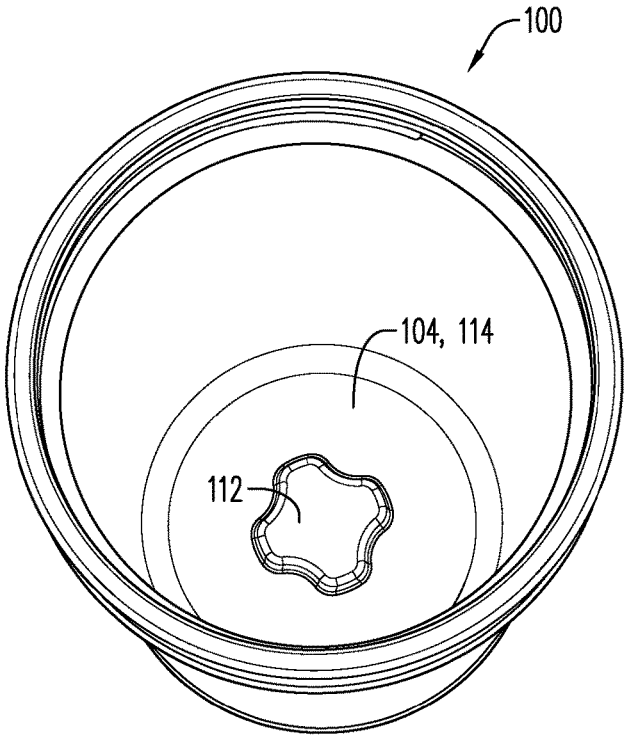
FIG. 4 is a top down view of the outer body of the container the container of FIG. 3, illustrating an outer body end wall and an interior surface of the outer body end wall, according to an embodiment.
Figure 5:
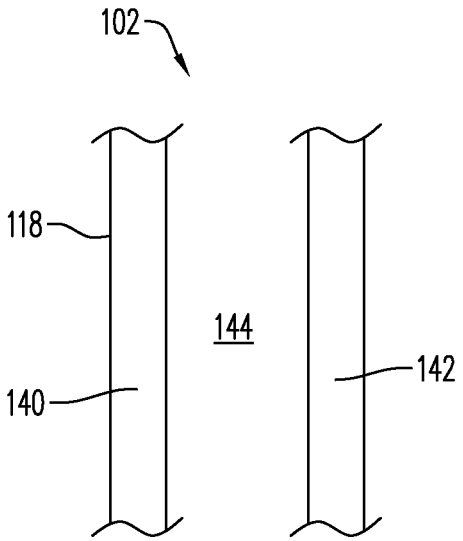
FIG. 5 is a schematic cross-sectional view of an outer body cylindrical wall of an outer body end wall of a container, according to an embodiment.
Figure 6:
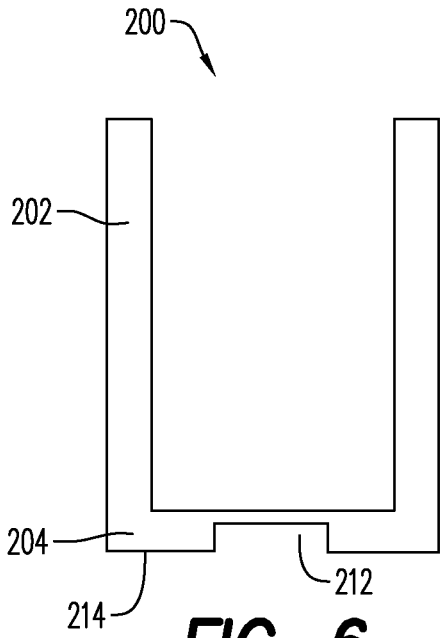
FIG. 6 is a schematic cross-sectional view of an inner body of a container, according to an embodiment.

The container 10 may include various contours or components to facilitate retention of the inner body 200 within the outer body 100. According to an aspect and as illustrated in FIG. 4, the outer body 100 further includes a lock protrusion 112 extending from an interior surface 114 of the outer body end wall 104. The inner body 200 may include a lock recess 212 (FIG. 6) provided on an exterior surface 214 of the inner body end wall 204. According to an aspect, the lock recess 212 is configured to detachably couple with the lock protrusion 112 so as to restrict rotation of the inner body 200 relative to the outer body 100. The lock protrusion 112 and the lock recess 212 may be frictionally engaged to restrict rotation of the inner body 200 relative to the outer body 100. According to an aspect, the lock protrusion 112 and the lock recess 212 are substantially cross-shaped when viewed along the axial direction. It is contemplated, however, that the lock protrusion 112 and the lock recess 212 may have different shapes. In some embodiments, the lock protrusion and corresponding lock recess may be formed on either of the outer body 100 or the inner body 200 interchangeably, and may jointly be configured to position and/or detachably couple the inner body 200 within the outer body 200.

Figure 27:
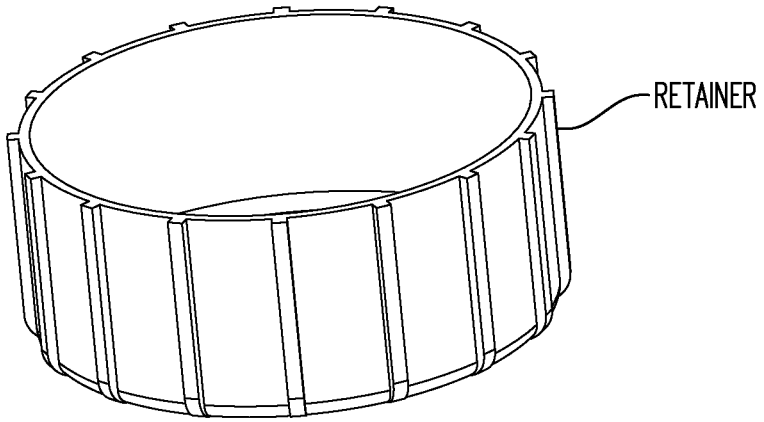
FIG. 27 is a retainer configured for securing the inner body within the outer body, for example for FIG. 26, according to an embodiment.

According to an aspect, the container 10 includes a retainer 1905, which may be configured as a cup-like structure (FIG. 19, FIG. 27 and FIG. 28). The retainer 1905 may be disposed within the interior space 108 of the outer body 100, for example disposed adjacent to the outer body end wall 104. The inner body 200 (e.g. its base) may be positioned and secured within the retainer 1905. In some embodiments, the retainer 1905 may be configured to snuggly fit the base of the inner body 200 being slid therewithin, for example providing a friction fit that securely holds the inner body 200 within the outer body 200. In some embodiments, the retainer 1905 may be configured to center/position the inner body 200 within the outer body 100. In some embodiments, the retainer 1905 may be formed of a shock-absorptive material, such as rubber or silicone, and/or may be more shock-absorptive than the outer body 100 or the inner body 200. In some embodiments, the retainer may extend upward from the outer body end wall 104 for up to ⅕, ¼, or ⅓ of the length of the outer body 100. In some embodiments, the inner body 200 and the outer body 100 (e.g. interior space 108/retainer 1905) may jointly be configured so that, when the inner body 200 is insert within the outer body 100, the sides of the inner body cylindrical wall 202 do not contact the inner surface of at least a portion of the outer body cylindrical wall 102, forming a gap therebetween (e.g. as discussed above). For example, at least the top/upper portion of the inner body 200 (e.g. the second end distal to or away from the base/first end) may not contact the inner surface of the outer body cylindrical wall (e.g. providing a gap configured to receive the cap 300 (e.g. the outer cover cylinder 306). In some embodiments, the outer cover cylinder 306 may snuggly fit between the outer body cylinder wall 102 (e.g. the inner surface of the interior space 108) and the inner body cylinder wall 202 (e.g. at the top of the container 10). In some embodiments, the gap between the inner body 200 and the outer body 100 may include an air insulating gap. In some embodiments, the retainer 1905 may snuggly fit between the outer body cylinder wall 102 and the inner body cylinder wall 202, for example when the inner body 200 is inserted/disposed within the outer body 100 (e.g. the retainer may fill a portion of the gap, for example having a width similar to the gap between the inner body 200 and the outer body 100, for example at the first end of the container). In some embodiments, the retainer 1905 may be configured to maintain the gap between the inner body 200 and the outer body 100, concentrically positioning the inner body 200 within the outer body 100. In some embodiments, the retainer 1905 may be friction fit within the outer body 100 and/or may be removable (for example, for cleaning purposes). In some embodiments, the retainer 1905 may be secured to the outer body 100, for example by adhesive. In some embodiments, the retainer 1905 may be configured for use with the lock recess-lock protrusion. For example, the retainer 1905 may include a hole or opening (not shown) corresponding to the lock recess-lock protrusion (e.g. to allow the lock protrusion to project therethrough for interaction with the lock recess, when the inner body 200 is disposed concentrically within the outer body 100). In some embodiments, the lock recess or lock protrusion may be disposed at least partially on or formed by the retainer 1905. In some embodiments, the retainer 1905 may be insulating. In some embodiments, the inner body 200 may not overlap with and/or contact any portion of the outer body 100, for example being spaced concentrically with a gap therebetween. In some embodiments, the second end 208 (e.g. sipping portion) of the inner body 200 may be spaced inward from the second end 110 of the outer body 100.

The components of the container 10 may include threaded connections to secure the components together. For example and as illustrated in FIG. 3, the outer body 100 includes an outer body thread 122 provided on an inner surface 124 of the outer body cylindrical wall 102 at the second end 110 of the outer body cylindrical wall 102. According to an aspect, the outer cover cylinder 306 includes a cover thread 308 provided on an outer surface of the outer cover cylinder 306. The outer body thread 122 is configured for engagement with the cover thread 308 (for example, as the outer cover cylinder 306 extends into the outer body 100). In some embodiments, the inner surface of the outer cover cylinder 306 may not have threads (e.g. may be smooth). In some embodiments, the inner and/or outer surface of the inner cover cylinder 304 may not have threads (e.g. may be smooth).

Figure 25:
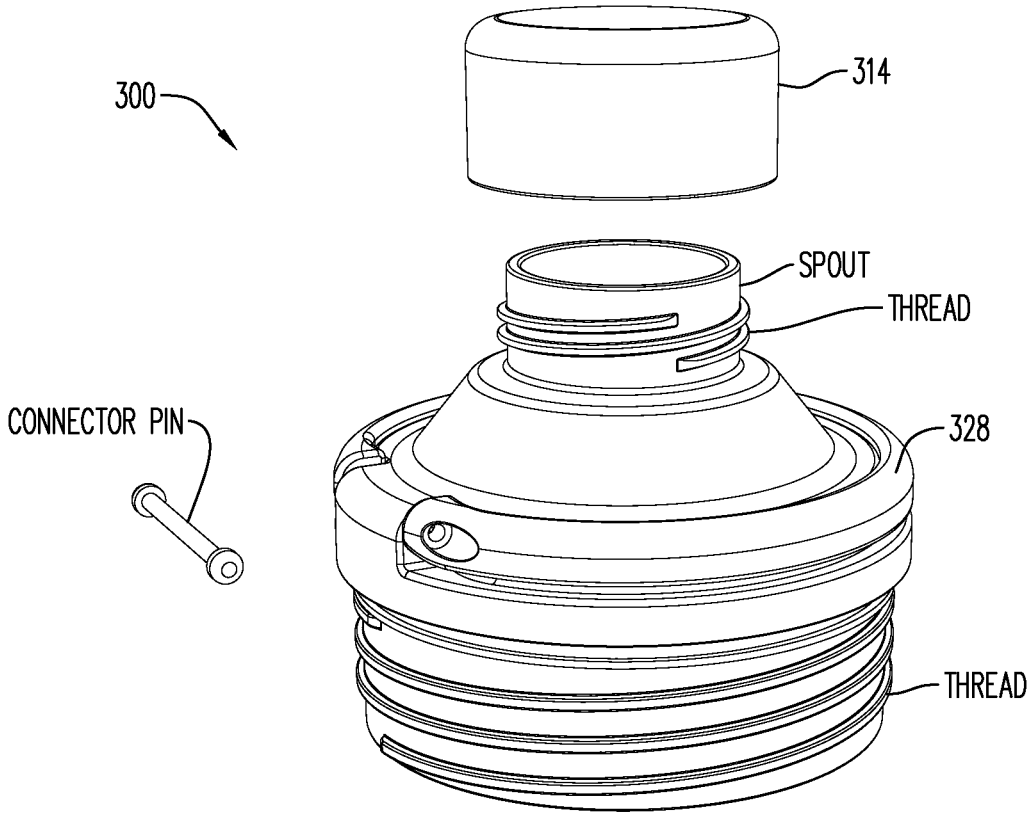
FIG. 25 is a perspective view of the cover of FIG. 24, according to an embodiment.

The container further includes a handle 328. The handle may be secured to the cover 300 using a connector pin (FIG. 25). The handle 328 may be formed in a ring shape. The handle 328 may be rotatably or pivotably coupled to the cover plate 302. According to an aspect, an inner radius of the handle 328 is larger than the radius of the second cover plate surface 324. In some embodiments, an indentation may be formed on the cover 300 (e.g. the space between the second cover plate surface 324 and the first cover plate surface 322), and the handle 328 and the indentation may be sized to correspond (for example, so that when the handle 328 is folded down around the second cover plate 324, it lays flush with the first cover plate surface 322, e.g. about its outer diameter). In some embodiments, when the handle 328 is folded down, it also may lay substantially flush on its top surface with the top/upper surface of the second cover plate surface 324. In some embodiments, the handle may include a beveled surface, which may angle inward from the outer diameter of the first cover plate surface 322 toward the outer diameter of the second cover plate surface 324. So, when folded flat, the handle 328 may be substantially within the frame/space defined by the cap 300 and/or the outer body 100 and/or may visually extend the second cover plate surface 324 outward to the first cover plate surface 322.

According to an aspect and as illustrated in FIGS. 17-18 and 20A-20B, the handle 328 is configured as a strap. The strap may be arranged so that a free end of the strap is inserted and secured within a loop. This may allow a user to carry the container 10 between different locations.

According to an aspect and as illustrated in, for example, FIG. 8, FIG. 12, FIG. 18 and FIG. 25, the container 10 further includes a cap 314 detachably coupled to the spout/spout cylinder 310. The cap 314 may include a cap cylindrical wall 316 having a cap inner diameter that is larger than a spout outer diameter of the spout cylinder 310. According to an aspect, the cap 314 further includes a cap disk 330 integrally formed with the cap cylindrical wall 316. A cap projection 332 may protrude from the cap disk 330 in a direction opposite from the cap cylindrical wall 316.

According to an aspect, a first inner cap cylinder 340 extending from the cap disk 330. An outer diameter of the first inner cap cylinder 340 may be less than an inner diameter of the spout cylinder 310. An inner cap shoulder 342 extends radially inward from the first inner cap cylinder, and a second inner cap cylinder 344 extends from the inner cap shoulder 342. An outer diameter of the second inner cap cylinder 344 is less than an inner diameter of the spout projection 334.

Figure 12:
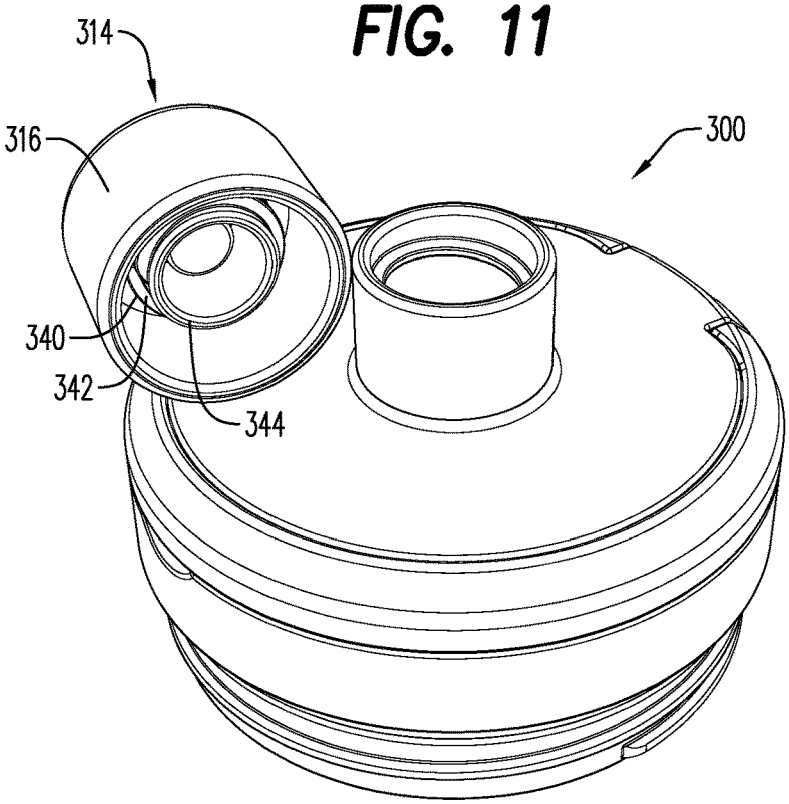
FIG. 12 is perspective view of the cap and cover of FIG. 11, illustrating the cap and cover in a disassembled configuration.
Figure 13:
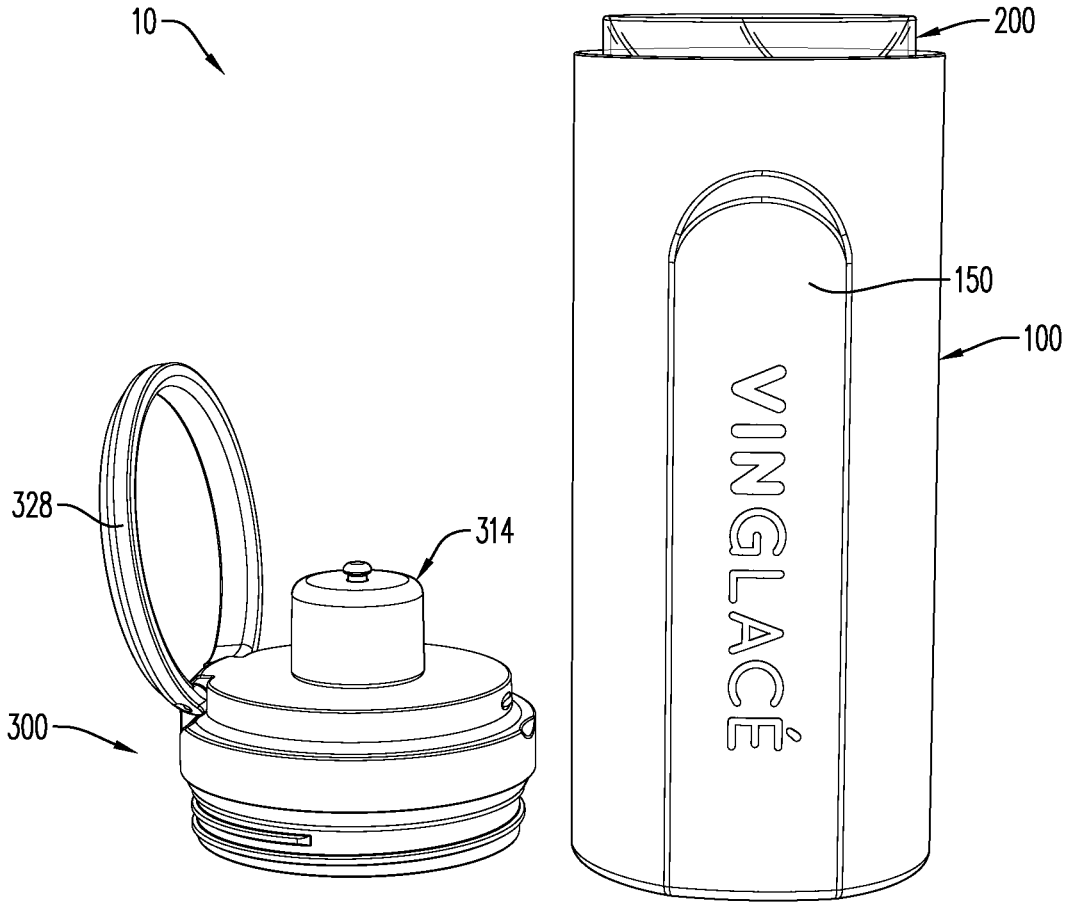
FIG. 13 is a side perspective view of a container, illustrating an inner body positioned within an outer body (e.g. with the inner body projecting out of the outer body), and a cover having a handle in an open configuration, according to an embodiment.
Figure 14:
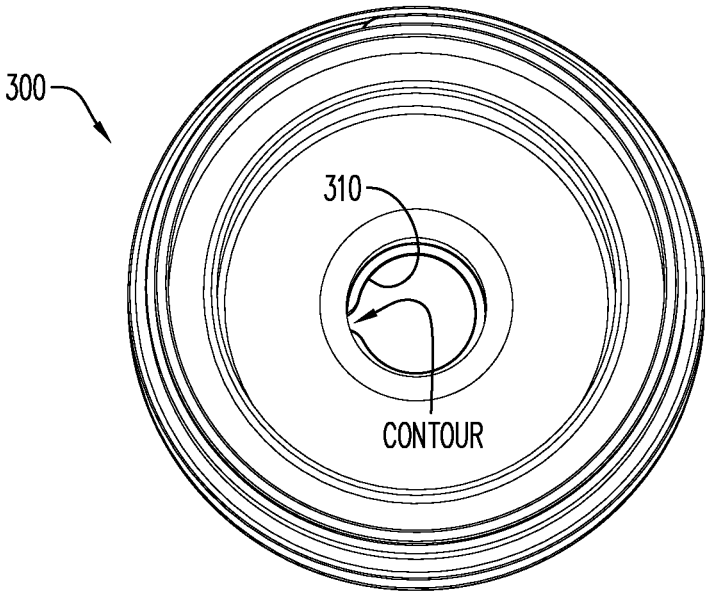
FIG. 14 is a bottom view of the cover, according to an embodiment.
Figure 15:
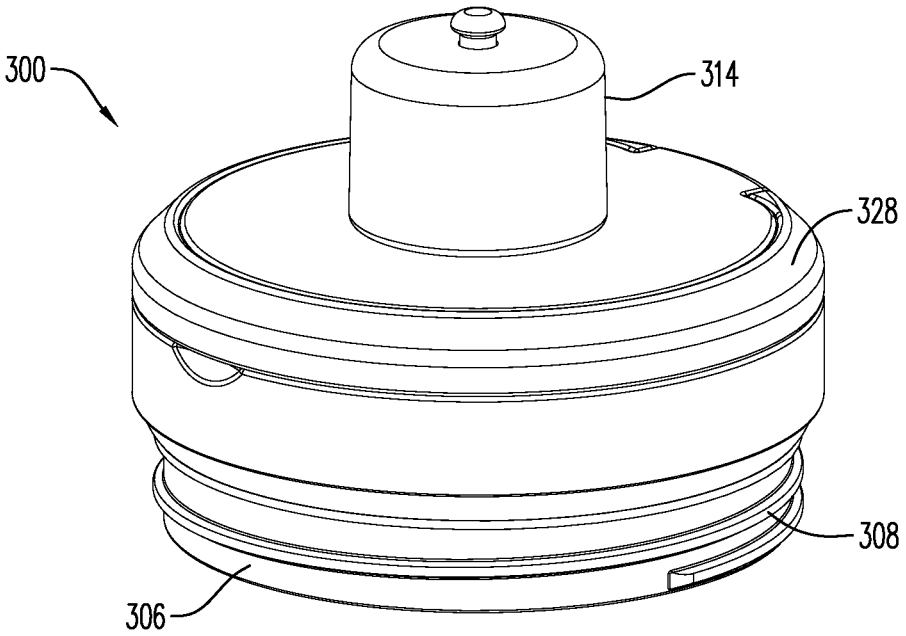
FIG. 15 is a side, perspective view of an assembled cover, according to an embodiment.
Figure 16:
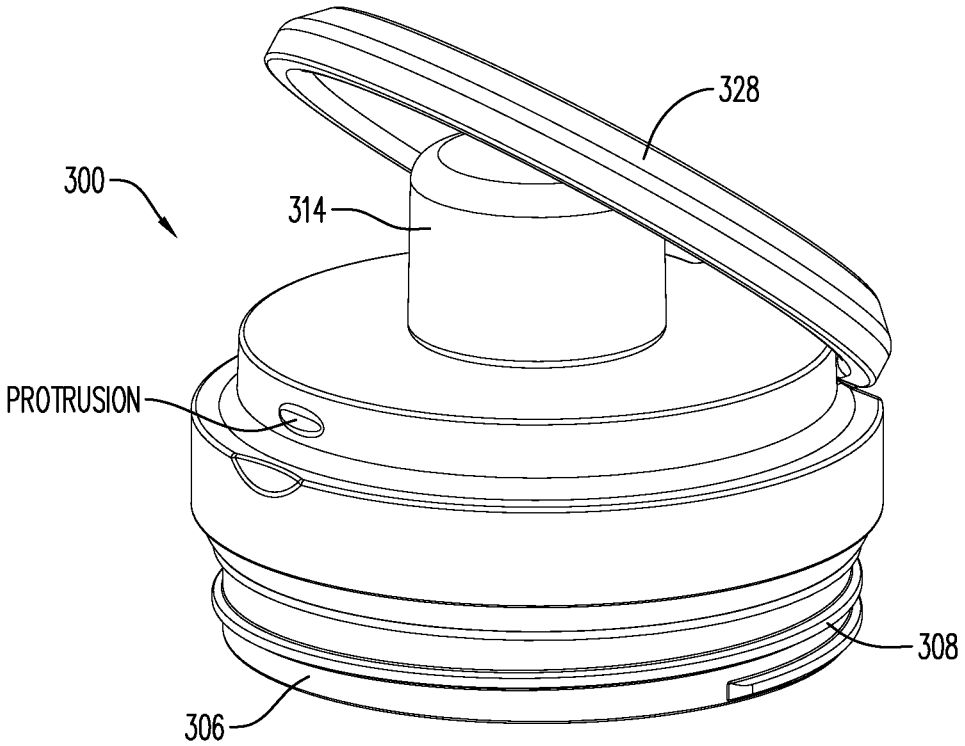
FIG. 16 is a side, perspective view of the assembled cover of FIG. 15, illustrating a handle in an open configuration, according to an embodiment.
Figure 17:
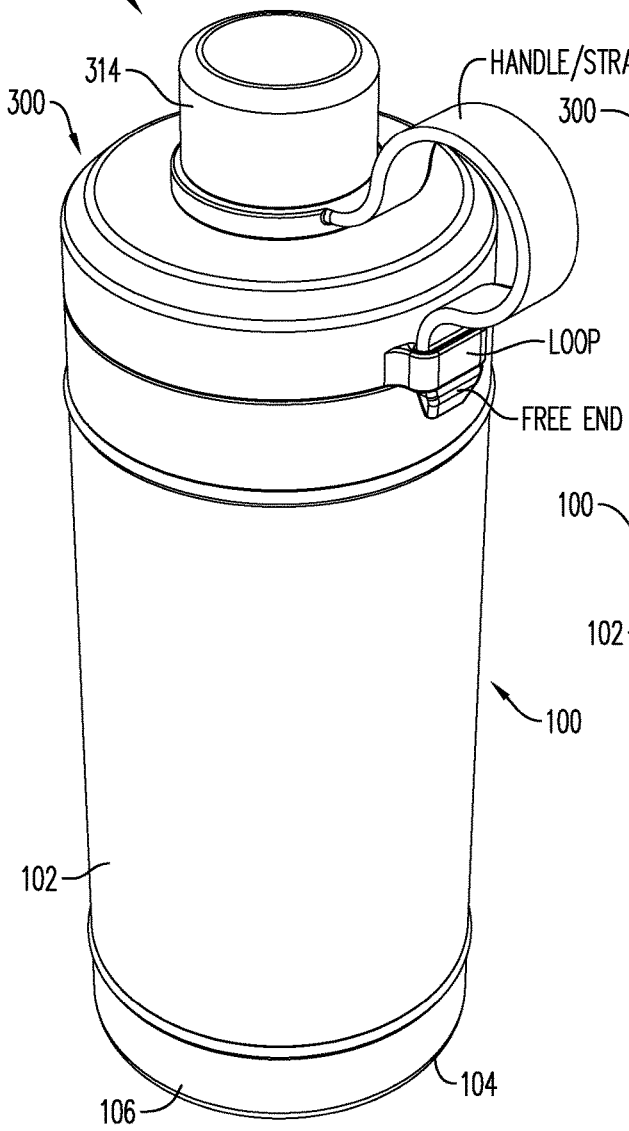
FIG. 17 is a top down, perspective view of a container, according to an embodiment.
Figure 18:
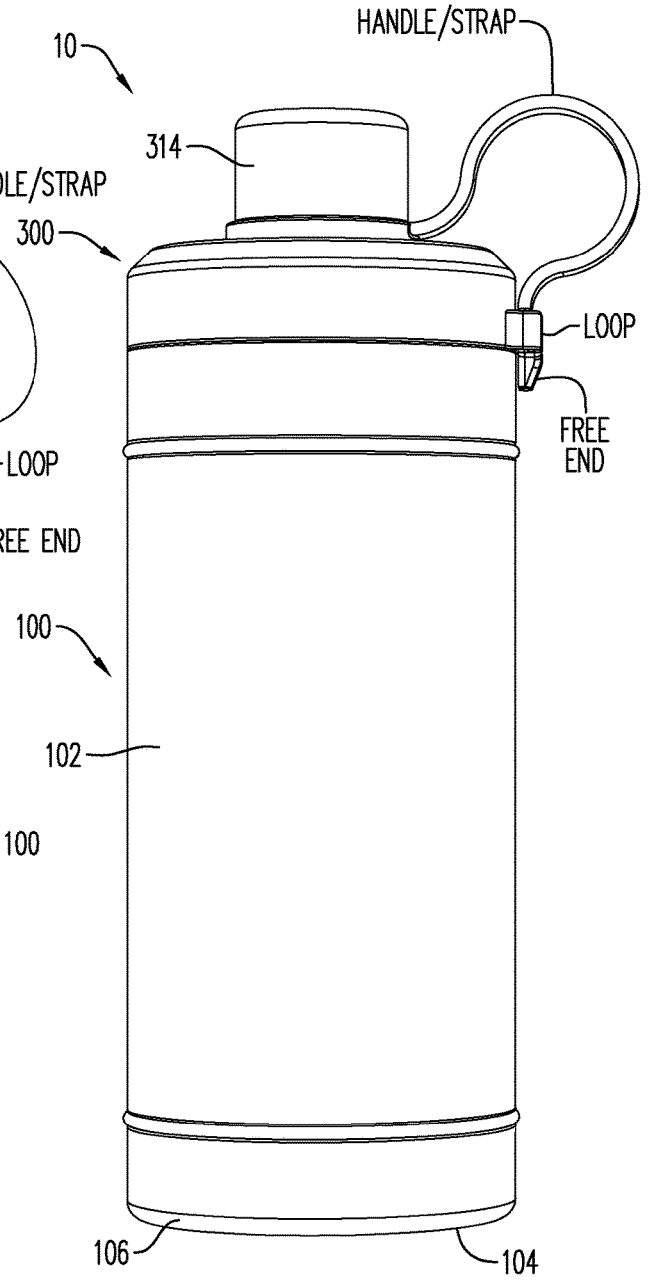
FIG. 18 is a side view of the container of FIG. 17, according to an embodiment.

The cap 314 may be frictionally retained to the spout (FIG. 12 and FIG. 19). Alternatively, and as illustrated in FIG. 25 and FIG. 28, the cap may be threadingly connected to the spout.

In some embodiments, the container 10 may be a water bottle or other beverage container. In some embodiments, the outer body 100 may be opaque and/or the inner body (or at least some portion, such as the top portion (e.g. second end), of the inner body 200) may be translucent, transparent, or not entirely opaque. In other embodiments, the outer body 100 may also be translucent or transparent. In some embodiments, the cover 300 may be opaque, while in other embodiments, the cover may be translucent or transparent. In some embodiments, the cover 300 and the outer body 100 may both be the same color and/or have the same opaqueness or translucence. In some embodiments, when the inner body 200 is seated within the outer body 100, the inner body 200 projects outward from the outer body 100 (e.g. forming a lip, rim, or sipping portion which projects vertically out of the outer body 100, which a user could sip from in instances when the cover 300 is removed). In some embodiments, the inner body 200 may include glass, ceramic, or some other breakable material (e.g. not shatter-resistant). In some embodiments, the outer body 100 may be formed of shatter-resistant material, such as aluminum, steel, or shatter-resistant plastic. In some embodiments, the inner body 200 may include a material that does not leach or impart taste to a beverage within. In some embodiments, the inner body 200 includes a food safe material (e.g. at least lining the inner surface of the cavity). In some embodiments, the inner body 200 has a smooth external surface, at least at the second end (e.g. top end/lip/rim). For example, the inner body 200 may not include any threads, either externally or internally. Particularly, the inner body 200 may not include any threads on the sipping portion (e.g. the second end).

In some embodiments, the inner body 200 may be removably disposed within the outer body 100, and may be configured to allow for removal for cleaning. In some embodiments, the inner body 200 may be dishwasher safe. For example, the inner body 200 may be removed from the outer body 100, placed in a dishwasher for cleaning, and after the dishwasher has completed a cleaning cycle, may be re-inserted within the outer body 100. In some embodiments, inserting the inner body 200 within the outer body 100 may include sliding the inner body 200 into the retainer 1905, which is disposed within the outer body 100 in proximity to its first end. In some embodiments, the inner body 200 may be secured within the outer body 100. While the retainer may secure the first end (e.g. base) of the inner body 200 within the outer body 100, in some embodiments the second end (e.g. top) of the inner body 200 may be secured within the outer body 100 by the cover 300, for example with the inner cover cylinder and the outer cover cylinder sandwiching the top of the inner body 200. In some embodiments, the inner seal member provided between the inner cover cylinder and the outer cover cylinder may assist in securing the inner body 200 in place and/or may seal the inner body cavity (e.g. preventing fluids within the cavity of the inner body 200 from exiting the cavity while the cover 300 is in place atop the inner body 200). While users might typically drink from the container though the spout 312 when the cover 300 is in place, when the cover 300 is removed the user may optionally drink by placing mouth on the lip/rim/sipping portion of the inner body 200 (for example without mouth contact on the outer body 100). In some embodiments, the sipping portion of the inner body 200 may extend out of the outer body 100 and may be spaced inward (e.g. by the concentric gap) from the outer body 100, allowing clearance for a user's lips to rest on the sipping portion without contacting the outer body 100.

Some embodiments may include a kit or package, having a two or more inner body 200 elements for each outer body 100 (for example, having two or three inner body 200 elements and a single outer body 100). Each of the inner bodies 200 of the kit may be substantially identical in size, shape, and/or configuration (e.g. configured to be used within the outer body 100). This may allow for continued use of the container 10 even while cleaning (e.g. in an automated dishwasher) an inner body 200 (e.g. using a second inner body with the outer body, while cleaning a first, dirty inner body), since the inner body 200 (which actually holds the beverage in its cavity) tends to need cleaning more regularly than the outer body 100. Additionally, this may provide for continued usage of the container 10 in the event that one of the inner bodies 200 breaks, since the inner body 200 may be less durable than the outer body 100. In some embodiments, two or more of the inner bodies may vary in color or material. For example, one of the inner bodies 200 may be glass, while another of the inner bodies 200 may be plastic (e.g. shatter-resistant plastic, which may be configured for use in sports/active applications). This may allow a user to customize the container based on specific usage. The kit may also include one or more covers 300, each of which may be configured for use with any/all of the outer body 100 and the plurality of inner bodies 200.

FIGS. 29-46 illustrate additional views of an exemplary embodiment of the container which may be similar in some respects to embodiments described above. In some embodiments, the exterior surface of the outer body may differ from that shown in the figures (for example, having one or more facets configured for gripping). In some embodiments, the exterior and/or the interior of the inner body may differ from that shown in the figures, for at least the portion of the inner body configured to be disposed within the outer body (e.g. with the portion of the inner body configured to project out of the outer body typically being configured as shown). In some embodiments, the outer body may be opaque and/or the inner body (or at least some portion, such as the top portion (e.g. second end), of the inner body projecting out of the outer body) may be translucent, transparent, or not entirely opaque. In some embodiments, the cover may be opaque. In some embodiments, the cover may be configured differently than shown here, for example with a different exterior shape, but typically the inner cover cylinder and the outer cover cylinder would project outward from the first side of the cover plate and be spaced apart sufficiently to allow the top (e.g. second end) of the inner body to fit radially between the outer cover cylinder and the inner cover cylinder when the cover is placed atop the container. In some embodiments, the outer surface of the cover would be configured to fit flush with the outer surface of the outer body, when the cover is disposed on the outer body, for example so that the attached cover may seem to form a continuous extension of the outer body, at least in part.

Some additional non-limiting examples of embodiments of this disclosure follow:

Example Set 1

Example 1: A container including: an outer body including: an outer body cylindrical wall extending in an axial direction; an outer body end wall provided at a first end of the outer body cylindrical wall in the axial direction, wherein the outer body cylindrical wall and the outer body end wall define an interior space; an inner body provided/disposed (e.g. removably) concentrically within the interior space, the inner body including: an inner body cylindrical wall extending in the axial direction; and an inner body end wall provided at a first end of the inner body cylindrical wall in the axial direction (and defining/forming a cavity configured to retain food or beverage); and a cover detachably coupled to the inner body and the outer body (and configured to seal the inner body). For example, the cover may be coupled to the inner body by having the outer cover cylinder and the inner cover cylinder sandwich the lip/rim/sipping portion (e.g. distal end, away from the end wall) of the inner body. In some examples, a gap (e.g. a concentric gap) may exist between the inner body and the outer body, for example configured to allow for the cover (e.g. the outer cover cylinder) to fit therebetween. In some examples, the rim/lip of the inner body does not extend radially to contact the outer body, when the inner body is in place within the outer body. For example, the rim of the outer body may be configured to be uncovered by the inner body (e.g. exposed, with no portion of the inner body extending to cover the rim of the outer body) when the inner body is disposed in the outer body and the cover is removed. In some examples, the rim of the outer body and the rim of the inner body may both be configured to contact the cover, for example with the outer cover cylinder disposed therebetween.

Example 2: The container of example 1, wherein a length of the inner body in the axial direction is greater than a length of the outer body in the axial direction.

Example 3: The container of any one of examples 1-2, wherein a second end (e.g. the top) of the inner body, the second end of the inner body being opposite to the first end of the inner body in the axial direction, is displaced in the axial direction from a second end (e.g. top) of the outer body, the second end of the outer body being opposite to the first end of the outer body in the axial direction. For example, when the inner body is disposed within the outer body, the inner body (e.g. the second end/top of the inner body) may project up out of the outer body.

Example 4: The container of any one of examples 1-3, wherein: the outer body further includes a lock protrusion extending from an interior surface of the outer body end wall; the inner body further includes a lock recess provided on an exterior surface of the inner body end wall; and the lock recess is configured to detachably couple with the lock protrusion so as to restrict rotation of the inner body relative to the outer body.

Example 5: The container of example 4, wherein the lock protrusion and the lock recess are frictionally engaged to restrict rotation of the inner body relative to the outer body (e.g. with corresponding/mating/meshing shapes, such as a cross, and x, or a star). For example, the shapes may be configured to prevent lateral movement or rotation of the inner body within the outer body.

Example 6: The container of any one of examples 4-5, wherein the lock protrusion and the lock recess are substantially cross-shaped when viewed along the axial direction.

Example 7: The container of any one of examples 1-6, wherein the outer body further includes: a groove formed on an exterior surface of the outer body cylindrical wall; and a bumper provided within the groove.

Example 8: The container of example 7, wherein: the groove is one of a plurality of grooves; and a bumper is provided within each groove of the plurality of grooves.

Example 9: The container of any one of examples 1-8, wherein the cover includes: a cover plate; an inner cover cylinder extending from the cover plate to a first side in the axial direction; and an outer cover cylinder concentric with the inner cover cylinder and extending from the cover plate to the first side in the axial direction. In some examples, the outer cover cylinder may extend further than the inner cover cylinder.

Example 10: The container of example 9, wherein a second end of the inner body cylindrical wall, the second end of the inner body cylindrical wall being opposite the first end of the inner body cylindrical wall in the axial direction, is positioned between the inner cover cylinder and the outer cover cylinder in a radial direction perpendicular to the axial direction.

Example 11: The container of any one of examples 9-10, wherein: the outer body includes an outer body thread provided on an inner surface of the outer body cylindrical wall at a second end of the outer body cylindrical wall opposite to the first end of the outer body cylindrical wall in the axial direction; the outer cover cylinder includes a cover thread provided on an outer surface of the outer cover cylinder; and the outer body thread is engaged with the cover thread.

Example 12: The container of any one of examples 9-11, further including: a spout cylinder extending from the cover plate to a second side in the axial direction opposite to the first side; and a bore extending through the spout cylinder and the cover plate.

Example 13: The container of example 12, further including a spout projection projecting inward from an inner surface of the spout cylinder.

Example 14: The container of example 13, wherein the spout projection extends for less than a total circumference of the inner surface of the spout cylinder.

Example 15: The container of example 12, further including a cap detachably coupled to the spout cylinder.

Example 16: The container of example 15, wherein: the cap includes a cap cylindrical wall; and the cap cylindrical wall has a cap inner diameter larger than a spout outer diameter of the spout cylinder.

Example 17: The container of example 16, wherein the cap further includes: a cap disk integrally formed with the cap cylindrical wall; a cap projection protruding from the cap disk in a direction opposite from the cap cylindrical wall.

Example 18: The container of example 17, further including a first inner cap cylinder extending from the cap disk.

Example 19: The container of example 18, wherein an outer diameter of the first inner cap cylinder is less than an inner diameter of the spout cylinder.

Example 20: The container of any one of examples 18-19, further including an inner cap shoulder extending radially inward from the first inner cap cylinder.

Example 21: The container of example 20, further including a second inner cap cylinder extending from the inner cap shoulder.

Example 22: The container of example 21, wherein an outer diameter of the second inner cap cylinder is less than an inner diameter of the spout projection.

Example 23: The container of any one of examples 9-12, further including an inner seal member provided between the inner cover cylinder and the outer cover cylinder in a radial direction, wherein the inner seal member is configured to secure the inner body within the outer body (e.g. between the inner cover cylinder and the outer cover cylinder) and/or to seal the inner body (e.g. so that the cover can sealingly close the cavity of the inner body).

Example 24: The container of any one of examples 9-23, further including an outer seal member provided on an outer surface of the outer cover cylinder (e.g. configured to seal the interior space of the outer body when the cover is in place on the outer body).

Example 25: The container of any one of examples 9-24, wherein: the cover plate further includes: a first cover plate surface; a second cover plate surface having a radius smaller than a radius of the first cover plate surface, the second cover plate surface being separated from the first cover plate surface to the second side in the axial direction; and a cover plate wall extending from the second cover plate surface to the first cover plate surface.

Example 26: The container of example 25, further including a handle rotatably coupled to the cover plate.

Example 27: The container of example 26, wherein: the handle is formed in a ring shape; and an inner radius of the handle is larger than the radius of the second cover plate surface. In some examples, the outer radius of the handle may be approximately the same as the outer radius of the first cover plate surface.

Example 28: The container of any one of examples 1-27, wherein the outer body is formed of a thermally insulating material.

Example 29: The container of any one of examples 1-28, wherein the inner body is formed of a glass.

Example 30: The container of any one of examples 1-29, wherein the outer body end wall is integrally formed with the outer body cylindrical wall.

Example 31: The container of any one of examples 1-30, wherein the inner body end wall is integrally formed with the outer body cylindrical wall.

Example 32: The container of any one of examples 1-31, wherein: the outer body includes: a first portion axially having a first portion inner diameter; and a second portion having a second portion inner diameter; wherein the second portion inner diameter is greater than the first portion inner diameter.

Example 33: The container of any one of examples 1-32, wherein the outer body cylindrical wall includes: an outer wall extending in the axial direction; and an inner wall extending in the axial direction, wherein the outer wall and the inner wall are spaced apart in a radial direction of the outer body cylindrical wall.

Example 34: The container of example 33, wherein a space between the outer wall and the inner wall is substantially evacuated of air (e.g. forming a vacuum gap therebetween).

Example 35: The container of any one of examples 1-33, wherein the outer body is vacuum-insulated.

Example 36: The container of any one of examples 1-33, wherein the outer body includes a first facet/depression formed on an outer surface of the outer body cylindrical wall.

Example 37: The container of example 36, wherein the outer body includes a second facet/depression formed on the outer surface of the outer body cylindrical wall, the second facet being displaced 180 degrees from the first face in a circumferential direction of the outer body cylinder wall.

Example 38: The container of any one of examples 36-37, further including a facet protrusion extending from the first facet.

Example Set 2

Example 39: A cover for use with a container, the cover including: a cover plate; an inner cover cylinder extending from the cover plate to a first side in the axial direction; and an outer cover cylinder concentric with the inner cover cylinder and extending from the cover plate to the first side in the axial direction.

Example 40: The cover of example 39, wherein the outer cover cylinder includes a cover thread provided on an outer surface of the outer cover cylinder.

Example 41: The cover of any one of examples 39-40, further including: a spout cylinder extending from the cover plate to a second side in the axial direction opposite to the first side; and a bore extending through the spout cylinder and the cover plate.

Example 42: The cover of example 39 further including a spout projection projecting inward from an inner surface of the spout cylinder.

Example 43: The cover of example 42, wherein the spout projection extends for less than a total circumference of the inner surface of the spout cylinder.

Example 44: The cover of example 39, further including a cap detachably coupled to the spout cylinder.

Example 45: The cover of example 44, wherein: the cap includes a cap cylindrical wall; and the cap cylindrical wall has a cap inner diameter larger than a spout outer diameter of the spout cylinder.

Example 46: The cover of example 45, wherein the cap further includes: a cap disk integrally formed with the cap cylindrical wall; and a cap projection protruding from the cap disk in a direction opposite from the cap cylindrical wall.

Example 47: The cover of example 46, further including a first inner cap cylinder extending from the cap disk.

Example 48: The cover of example 47, wherein an outer diameter of the first inner cap cylinder is less than an inner diameter of the spout cylinder.

Example 49: The cover of any one of examples 47-48, further including an inner cap shoulder extending radially inward from the first inner cap cylinder.

Example 50: The cover of example 49, further including a second inner cap cylinder extending from the inner cap shoulder.

Example 51: The cover of example 50, wherein an outer diameter of the second inner cap cylinder is less than an inner diameter of the spout projection.

Example 52: The cover of any one of examples 39-51, further including an inner seal member provided between the inner cover cylinder and the outer cover cylinder in a radial direction.

Example 53: The cover of any one of examples 39-52, further including an outer seal member provided on an outer surface of the outer cover cylinder.

Example 54: The cover of any one of examples 39-53, wherein: the cover plate further includes: a first cover plate surface; a second cover plate surface having a radius smaller than a radius of the first cover plate surface, the second cover plate surface being separated from the first cover plate surface to the second side in the axial direction; and a cover plate wall extending from the second cover plate surface to the first cover plate surface.

Example 55: The cover of example 54, further including a handle rotatably coupled to the cover plate.

Example 56: The cover of example 55, wherein: the handle is formed in a ring shape; and an inner radius of the handle is larger than the radius of the second cover plate surface.

Example Set 3

Example 57: A container body including: a cylindrical wall extending in an axial direction; and an end wall provided at a first end of the cylindrical wall in the axial direction.

Example 58: The container body of example 57, further including a lock protrusion extending from an interior surface of the end wall.

Example 59: The container body of example 58, wherein the lock protrusion is configured to frictionally engage with a complementary lock recess of a second body so as to restrict rotation of the container body relative to the second body.

Example 60: The container body of any one of examples 58-59, wherein the lock protrusion is substantially cross-shaped when viewed along a central axis of the container body.

Example 61: The container body of any one of examples 57-60, further including: a groove formed on an exterior surface of the cylindrical wall; and a bumper provided within the groove.

Example 62: The container body of example 61, wherein: the groove is one of a plurality of grooves; and a bumper is provided within each groove of the plurality of grooves.

Example 63: The container body of any one of examples 57-62, further including a thread provided on an inner surface of the cylindrical wall at a second end of the cylindrical wall opposite to the first end of the cylindrical wall in the axial direction.

Example 64: The container body of any one of examples 57-63, wherein the cylindrical wall and the end wall are integrally formed.

Example 65: The container body of any one of examples 57-64, wherein the container body is formed of a thermally insulating material.

Example 66: The container body of body of any one of examples 57-65, wherein the cylindrical wall includes: a first portion axially having a first portion inner diameter; and a second portion having a second portion inner diameter; wherein the second portion inner diameter is greater than the first portion inner diameter.

Example 67: The container body of any one of examples 57-66, wherein the cylindrical wall further includes: an outer wall extending in the axial direction; and an inner wall extending in the axial direction, wherein the outer wall and the inner wall are spaced apart in a radial direction of the cylindrical wall.

Example 68: The container body of example 67, wherein a space between the outer wall and the inner wall is substantially evacuated of air.

Example 69: The container body of any one of examples 67-68, wherein the container body is insulated. For example, the container body may be vacuum-insulated.

Example 70: The container body of any one of examples 57-69, further including a first facet formed on an outer surface of the cylindrical wall.

Example 71: The container body of example 70, further including a second facet formed on the outer surface of the cylindrical wall, the second facet being displaced 180 degrees from the first face in a circumferential direction of the cylinder wall.

Example 72: The container body of any one of examples 70-71, further including a facet protrusion extending from the first facet.

Example 73: The container body of example 57, further including a lock recess provided on an exterior surface of the end wall.

Example 74: The container body of example 73, wherein the lock recess is configured to frictionally engage with a complementary lock protrusion of a second body so as to restrict rotation of the container body relative to the second body.

Example 75: The container body of any one of examples 73-74, wherein the lock recess is substantially cross-shaped when viewed along a central axis of the container body.

Example 76: The container body of any one of examples 58 and 73-75, wherein the container body is formed of a glass.

Example 77: The container body of any one of examples 58 and 73-76, wherein the end wall is integrally formed with the cylindrical wall.

This disclosure, in various embodiments, configurations and aspects, includes components, methods, processes, systems, and/or apparatuses as depicted and described herein, including various embodiments, sub-combinations, and subsets thereof. This disclosure contemplates, in various embodiments, configurations and aspects, the actual or optional use or inclusion of, e.g., components or processes as may be well-known or understood in the art and consistent with this disclosure though not depicted and/or described herein.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that the appended claims should cover variations in the ranges except where this disclosure makes clear the use of a particular range in certain embodiments.

The terms "determine", "calculate" and "compute," and variations thereof, as used herein, are used interchangeably and include any type of methodology, process, mathematical operation or technique.

This disclosure is presented for purposes of illustration and description. This disclosure is not limited to the form or forms disclosed herein. In the Detailed Description of this disclosure, for example, various features of some exemplary embodiments are grouped together to representatively describe those and other contemplated embodiments, configurations, and aspects, to the extent that including in this disclosure a description of every potential embodiment, variant, and combination of features is not feasible. Thus, the features of the disclosed embodiments, configurations, and aspects may be combined in alternate embodiments, configurations, and aspects not expressly discussed above. For example, the features recited in the following claims lie in less than all features of a single disclosed embodiment, configuration, or aspect. Thus, the following claims are hereby incorporated into this Detailed Description, with each claim standing on its own as a separate embodiment of this disclosure.

Advances in science and technology may provide variations that are not necessarily express in the terminology of this disclosure although the claims would not necessarily exclude these variations.

What is claimed is:

1. A container comprising:

an outer body comprising:

an outer body cylindrical wall extending in an axial direction;

an outer body end wall provided at a first end of the outer body cylindrical wall in the axial direction, wherein the outer body cylindrical wall and the outer body end wall define an interior space;

an inner body removably provided concentrically within the interior space, the inner body comprising:

an inner body cylindrical wall extending in the axial direction;

an inner body end wall provided at a first end of the inner body cylindrical wall in the axial direction; and a cover detachably coupled to the inner body and the outer body, wherein the cover comprises:

a cover plate;

an inner cover cylinder extending from the cover plate to a first side in the axial direction; and an outer cover cylinder concentric with the inner cover cylinder and extending from the cover plate to the first side in the axial direction; and wherein a second end of the inner body cylindrical wall, disposed opposite the first end of the inner body cylindrical wall in the axial direction, is positioned between the inner cover cylinder and the outer cover cylinder in a radial direction perpendicular to the axial direction.

2. The container of claim 1, wherein a length of the inner body in the axial direction is greater than a length of the outer body in the axial direction.

3. The container of claim 1, wherein a second end of the inner body, disposed opposite to the first end of the inner body in the axial direction, is displaced in the axial direction from a second end of the outer body, disposed opposite to the first end of the outer body in the axial direction.

4. The container of claim 1, wherein:

the outer body comprises an outer body thread provided on an inner surface of the outer body cylindrical wall at a second end of the outer body cylindrical wall opposite to the first end of the outer body cylindrical wall in the axial direction;

the outer cover cylinder comprises a cover thread provided on an outer surface of the outer cover cylinder; and the outer body thread is engaged with the cover thread.

5. The container of claim 1, further comprising an inner seal member provided between the inner cover cylinder and the outer cover cylinder in a radial direction, wherein the inner seal member secures the inner body within the outer body.

6. The container of claim 5, further comprising an outer seal member provided on an outer surface of the outer cover cylinder.

7. The container of claim 1, wherein the inner body is formed of a glass.

8. The container of claim 1, wherein the outer body cylindrical wall comprises:

an outer wall extending in the axial direction; and an inner wall extending in the axial direction, wherein the outer wall and the inner wall are spaced apart in a radial direction of the outer body cylindrical wall.

9. The container of claim 8, wherein a space between the outer wall and the inner wall is substantially evacuated of air.

10. The container of claim 1, wherein the outer body is vacuum-insulated.

11. The container of claim 1, wherein the outer body further comprises a lock protrusion extending from an interior surface of the outer body end wall, wherein the inner container further comprises a lock recess provided on an exterior surface of the inner body end wall, and wherein the lock recess is configured to detachably couple with the lock protrusion so as to restrict rotation of the inner body relative to the outer body.

12. A cover for use with a container having an inner body disposed within an outer body, the cover comprising:

a cover plate;

an inner cover cylinder extending from the cover plate to a first side in the axial direction; and an outer cover cylinder concentric with the inner cover cylinder and extending from the cover plate to the first side in the axial direction, wherein:

a gap extends radially between the inner cover cylinder and the outer cover cylinder, the gap is configured to contain a top end portion of the inner body of the container between the inner cover cylinder and the outer cover cylinder, and the outer cover cylinder is configured for attachment to a top end portion of the outer body of the container.

13. The cover of claim 12, wherein the outer cover cylinder comprises a cover thread provided on an outer surface of the outer cover cylinder.

14. The cover of claim 12, further comprising:

a spout cylinder extending from the cover plate to a second side in the axial direction opposite to the first side; and a bore extending through the spout cylinder and the cover plate.

15. The cover of claim 12, further comprising an inner seal member provided between the inner cover cylinder and the outer cover cylinder in a radial direction and configured to sealingly engage the top end portion of the inner body of the container; and an outer seal member provided on an outer surface of the outer cover cylinder.

16. A container comprising:

an outer body comprising:

an outer body cylindrical wall extending in an axial direction; and an outer body end wall provided at a first end of the outer body cylindrical wall in the axial direction, wherein the outer body cylindrical wall and the outer body end wall define an interior space;

an inner body removably provided concentrically within the interior space, the inner body comprising:

an inner body cylindrical wall extending in the axial direction; and an inner body end wall provided at a first end of the inner body cylindrical wall in the axial direction;

a cover configured to detachably couple to the inner body and the outer body, wherein the cover comprises:

a cover plate;

an inner cover cylinder extending from the cover plate to a first side in the axial direction; and an outer cover cylinder concentric with the inner cover cylinder and extending from the cover plate to the first side in the axial direction; and wherein:

the outer body comprises an outer body thread provided on an inner surface of the outer body cylindrical wall at a second end of the outer body cylindrical wall opposite to the first end of the outer body cylindrical wall in the axial direction, the outer cover cylinder comprises a cover thread provided on an outer surface of the outer cover cylinder, and the outer body thread is configured to removably engage with the cover thread.

17. The container of claim 16, wherein the outer body further comprises:

a groove formed on an exterior surface of the outer body cylindrical wall; and a bumper provided within the groove.

18. The container of claim 16, wherein a gap is formed between the inner body cylinder wall and the outer body cylinder wall, and wherein a second end of the inner body cylindrical wall, disposed opposite the first end of the inner body cylindrical wall in the axial direction, is configured to be positioned between the inner cover cylinder and the outer cover cylinder in a radial direction perpendicular to the axial direction.

19. The container of claim 16, further comprising a retainer disposed within the interior space of the outer body, adjacent to the outer body end wall, wherein the inner body end wall is positioned and secured within the retainer.

20. The container of claim 19, wherein the outer body further comprises a lock protrusion extending from an interior surface of the end wall, and the inner body further comprises a lock recess provided on an exterior surface of the inner body end wall, the lock recess being configured to detachably couple with the lock protrusion so as to restrict rotation of the inner body relative to the outer body.

* * * * *